US008244526B2

(12) United States Patent
Vos et al.

(10) Patent No.: US 8,244,526 B2
(45) Date of Patent: Aug. 14, 2012

(54) SYSTEMS, METHODS, AND APPARATUS FOR HIGHBAND BURST SUPPRESSION

(75) Inventors: Koen Bernard Vos, San Francisco, CA (US); Ananthapadmanabhan Arasanipalai Kandhadai, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 988 days.

(21) Appl. No.: 11/397,433

(22) Filed: Apr. 3, 2006

(65) Prior Publication Data

US 2007/0088541 A1 Apr. 19, 2007

Related U.S. Application Data

(60) Provisional application No. 60/667,901, filed on Apr. 1, 2005, provisional application No. 60/673,965, filed on Apr. 22, 2005.

(51) Int. Cl.
*G10L 21/02* (2006.01)
*G10L 19/00* (2006.01)

(52) U.S. Cl. ..... 704/226; 704/233; 704/500; 704/501

(58) Field of Classification Search ..... 704/226, 704/233, 500–504
See application file for complete search history.

(56) References Cited

U.S. PATENT DOCUMENTS 3,158,693 A 11/1964 Flanagan
3,855,414 A 12/1974 Alleva et al.
3,855,416 A 12/1974 Fuller
4,616,659 A * 10/1986 Prezas et al. ..... 600/519
4,630,305 A * 12/1986 Borth et al. ..... 381/94.3
4,696,041 A * 9/1987 Sakata ..... 704/253
4,747,143 A * 5/1988 Kroeger et al. ..... 704/225
4,805,193 A 2/1989 McLaughlin et al.
4,852,179 A 7/1989 Fette
4,862,168 A 8/1989 Beard
5,077,798 A 12/1991 Ichikawa et al.
5,086,475 A 2/1992 Kutaragi et al.

(Continued)

FOREIGN PATENT DOCUMENTS

CA 2429832 6/2002

(Continued)

OTHER PUBLICATIONS

Vaseghi, "Advanced digital signal processing and noise reduction", chapter 13, Published by John Wiley and Sons Ltd., 2000.*

(Continued)

*Primary Examiner* — Jialong He
(74) *Attorney, Agent, or Firm* — Heejong Yoo

(57) ABSTRACT

In one embodiment, a highband burst suppressor includes a first burst detector configured to detect bursts in a lowband speech signal, and a second burst detector configured to detect bursts in a corresponding highband speech signal. The lowband and highband speech signals may be different (possibly overlapping) frequency regions of a wideband speech signal. The highband burst suppressor also includes an attenuation control signal calculator configured to calculate an attenuation control signal according to a difference between outputs of the first and second burst detectors. A gain control element is configured to apply the attenuation control signal to the highband speech signal. In one example, the attenuation control signal indicates an attenuation when a burst is found in the highband speech signal but is absent from a corresponding region in time of the lowband speech signal.

30 Claims, 19 Drawing Sheets

U.S. PATENT DOCUMENTS 5,119,424 A 6/1992 Asakawa et al.
5,285,520 A 2/1994 Matsumoto et al.
5,455,888 A 10/1995 Iyengar et al.
5,581,652 A 12/1996 Abe et al.
5,684,920 A 11/1997 Iwakami et al.
5,689,615 A 11/1997 Benyassine et al.
5,694,426 A 12/1997 McCree et al.
5,699,477 A 12/1997 McCree
5,699,485 A 12/1997 Shoham
5,704,003 A 12/1997 Kleijn et al.
5,706,395 A 1/1998 Arslan et al.
5,727,085 A 3/1998 Toyama et al.
5,737,716 A 4/1998 Bergstrom et al.
5,757,938 A 5/1998 Akagiri et al.
5,774,842 A 6/1998 Nishio et al.
5,797,118 A 8/1998 Saito
5,890,126 A 3/1999 Lindemann
5,966,689 A 10/1999 McCree
5,978,759 A 11/1999 Tsushima et al.
6,009,395 A 12/1999 Lai et al.
6,014,619 A 1/2000 Wuppermann et al.
6,029,125 A 2/2000 Hagen et al.
6,041,297 A 3/2000 Goldberg
6,097,824 A 8/2000 Lindemann et al.
6,134,520 A 10/2000 Ravishankar
6,144,936 A 11/2000 Jarvinen et al.
6,223,151 B1 4/2001 Kleijn et al.
6,263,307 B1 7/2001 Arslan
6,301,556 B1 10/2001 Hagen et al.
6,330,534 B1 12/2001 Yasunaga et al.
6,330,535 B1 12/2001 Yasunaga et al.
6,353,808 B1 3/2002 Matsumoto et al.
6,385,261 B1 * 5/2002 Tsuji et al. ..... 375/346
6,385,573 B1 5/2002 Gao et al.
6,449,590 B1 9/2002 Gao
6,523,003 B1 2/2003 Chandran et al.
6,564,187 B1 5/2003 Kikumoto et al.
6,675,144 B1 1/2004 Tucker et al.
6,678,654 B2 1/2004 Zinser, Jr. et al.
6,680,972 B1 1/2004 Liljeryd et al.
6,681,204 B2 1/2004 Matsumoto et al.
6,704,702 B2 3/2004 Oshikiri et al.
6,704,711 B2 3/2004 Gustafsson et al.
6,711,538 B1 3/2004 Omori et al.
6,715,125 B1 3/2004 Juang
6,732,070 B1 5/2004 Rotola-Pukkila et al.
6,735,567 B2 5/2004 Gao et al.
6,751,587 B2 6/2004 Thyssen et al.
6,757,395 B1 * 6/2004 Fang et al. ..... 381/94.3
6,757,654 B1 6/2004 Westerlund et al.
6,772,114 B1 8/2004 Sluijter et al.
6,826,526 B1 11/2004 Norimatsu et al.
6,879,955 B2 4/2005 Rao
6,889,185 B1 5/2005 McCree
6,895,375 B2 5/2005 Malah et al.
6,925,116 B2 8/2005 Liljeryd et al.
6,988,066 B2 1/2006 Malah
7,003,451 B2 2/2006 Kjorling et al.
7,016,831 B2 3/2006 Suzuki et al.
7,024,354 B2 4/2006 Ozawa
7,031,912 B2 4/2006 Yajima et al.
7,050,972 B2 5/2006 Henn et al.
7,069,212 B2 6/2006 Tanaka et al.
7,088,779 B2 8/2006 Aarts
7,136,810 B2 11/2006 Paksoy et al.
7,149,683 B2 12/2006 Jelinek
7,155,384 B2 12/2006 Banba
7,167,828 B2 1/2007 Ehara
7,174,135 B2 2/2007 Sluijter et al.
7,191,123 B1 3/2007 Bessette et al.
7,191,125 B2 3/2007 Huang
7,222,069 B2 5/2007 Suzuki et al.
7,228,272 B2 6/2007 Rao
7,242,763 B2 7/2007 Etter
7,260,523 B2 8/2007 Paksoy et al.
7,330,814 B2 2/2008 McCree
7,346,499 B2 3/2008 Chennoukh et al.
7,359,854 B2 4/2008 Nilsson et al.
7,376,554 B2 5/2008 Ojala et al.
7,386,444 B2 6/2008 Stachurski
7,392,179 B2 6/2008 Yasunaga et al.
7,596,492 B2 9/2009 Sung et al.
7,613,603 B2 11/2009 Yamashita
2003/0004718 A1 1/2003 Rao
2003/0036905 A1 2/2003 Toguri et al.
2003/0154074 A1 8/2003 Kikuiri et al.
2004/0019492 A1 1/2004 Tucker et al.
2004/0098255 A1 5/2004 Kovesi
2004/0128126 A1 7/2004 Nam
2004/0153313 A1 8/2004 Aubauer et al.
2004/0181398 A1 9/2004 Sung et al.
2004/0204935 A1 10/2004 Anandakumar et al.
2005/0004793 A1 1/2005 Ojala et al.
2005/0071153 A1 3/2005 Tammi et al.
2005/0071156 A1 * 3/2005 Xu et al. ..... 704/226
2005/0143989 A1 6/2005 Jelinek
2005/0251387 A1 11/2005 Jelinek et al.
2006/0206319 A1 9/2006 Taleb
2006/0206334 A1 9/2006 Kapoor et al.
2006/0271356 A1 11/2006 Vos et al.
2006/0277038 A1 12/2006 Vos et al.
2006/0277039 A1 12/2006 Vos et al.
2006/0277042 A1 12/2006 Vos et al.
2006/0282262 A1 12/2006 Vos et al.
2006/0282263 A1 12/2006 Vos et al.
2007/0088541 A1 4/2007 Vos et al.
2007/0088542 A1 4/2007 Vos et al.
2007/0088558 A1 4/2007 Vos et al.
2008/0126086 A1 5/2008 Vos et al.

FOREIGN PATENT DOCUMENTS

EP 0732687 9/1996
EP 1008984 6/2000
EP 1089258 4/2001
EP 1126620 8/2001
EP 1164579 12/2001
EP 1300833 4/2003
EP 1498873 1/2005
JP 2244100 A 9/1990
JP 08180582 7/1996
JP 8248997 A 9/1996
JP 8305396 A 11/1996
JP 9101798 A 4/1997
JP 2000206989 A 7/2000
JP 2001100773 A 4/2001
JP 2001237708 A 8/2001
JP 2001337700 A 12/2001
JP 2002268698 9/2002
JP 2003243990 A 8/2003
JP 2003526123 T 9/2003
JP 2004126011 A 4/2004
JP 2005345707 A 12/2005
KR 1020010023579 3/2001
RU 2073913 2/1997
RU 2131169 5/1999
RU 2233010 7/2004
TW 525147 3/2003
TW 526468 4/2003
WO 9848541 10/1998
WO 0156021 8/2001
WO WO 02052738 7/2002
WO 02086867 10/2002
WO 03021993 3/2003
WO 03044777 5/2003

OTHER PUBLICATIONS

International Search Report—PCT/US2006/012228, International Search Authority—European Patent Office—Jul. 25, 2006.

International Preliminary Report on Patentability—PCT/US2006/012228, International Search Authority—The International Bureau of WIPO, Geneva, Switzerland—Oct. 3, 2007.

Written Opinion—PCT/US2006/012228, International Search Authority—European Patent Office—Jul. 25, 2006.

Bessette, B., Salami, R., Lefebvre, R., Jellnek, M., Rotola-Pukkila, J., Valnlo, J., Mikkola, H., Jarvinen, K., "The Adaptive Multirate Wideband Speech Codec (AMR-WB)," IEEE Tr. on Speech and Audio Processing, vol. 10, No. 8, Nov. 2002, pp. 620-636.
McCree, A., "A 14 kb/s Wideband Speech Coder With a Parametric Highband Model," Int. Conf. on Acoustic Speech and Signal Processing, Turkey, 2000, pp. 1153-1156.
3rd Generation Partnership Project 2 ("3GPP2"). Enhanced Variable Rate Codec, Speech Service Options 3, 68, and 70 for Wideband Spread Spectrum Digital Systems, 3GPP2 C.S0014-C, ver. 1.0, Jan. 2007.
Budagavi, M. et al.: "Speech Coding in Mobile Radio Communications," Proc. IEEE, vol. 86, No. 7, Jul. 1998. pp. 1402-1412.
Chu, W. et al. Optimization of window and LSF interpolation factor for the ITU-T G.729 speech coding standard, 4 pp. (Eurospeech 2003, Geneva, pp. 1061-1064.
D17 So. S. Efficient Block Quantisation for Image and Speech Coding. PhD. Thesis, Griffith Univ., Brisbane, AU, Mar. 2005. Cover and chs. 5 and 6 (pp. 195-293).
Dattoro J et al:"Error spectrum Shaping and Vector Quantization" (ONLINE) Oct. 1997, XP002307027 Stanford University, Retrieved from the Internet: URL: WWW. Stanford. Edu/{dattorro/proj392c. pdf> [retrieved on Jun. 23, 2005].
Digital Radio Mondiale (DRM); System Specification; ETSI ES 201 980. ETSI Standards, European Telecommunications Standards Institute, Sophia-Antipo, FR, vol. BC, No. V122, Apr. 2003, XP 014004528, ISSN: 0000-0001, pp. 1-188.
Drygajilo, A. Speech Coding Techniques and Standards. Last accessed Dec. 15, 2006 at http://scgwww.epfl.ch/courses/Traitement_de_la_parole-2004-2005-pdf/12-codage%20Ppur-Drygajlo-Chapter-4-3.pdf. 23 pp. (chapter of Speech and Language Engineering.
Epps, J. "Wideband Extension of Narrowband Speech for Enhancement and Coding." Ph.D. thesis, Univ. of New South Wales, Sep. 2000. Cover, chs. 4-6 (pp. 66-121), and ch. 7 (pp. 122-129).
European Telecommunications Standards Institute (ETSI) 3rd Generation partnership Project (3GPP), Digital cellular telecommunications system (Phase 2+). Enhanced Full Rate (EFR) speech transcoding, GSM 06.60, ver. 8.0.1, Release 1999.
European Telecommunications Standards Institute (ESTI) 3rd Generation Partnership Project (3GPP). Digital cellular telecommunications system (Phase 2+), Full rate speech, Transcoding, GSM 06.10, ver. 8.1.1, Release 1999.
Guibe, G. et al. Speech Spectral Quantizers for Wideband Speech Coding. 11 pp. :Last accessed Dec. 14, 2006 at http://eprints.ecs.soton.ac.uk/6376/01/1178_pap.pdf (Euro. Trans. on Telecom., 12(6), pp. 535-545, 2001.
Guleryuz, O et al,: "On the DPCM Compression of Gaussian Autho-Regressive Sequence," 33 pages. Last accessed Dec. 14, 2006 at http://eeweb.poly.edu/~onur/publish/dpcm.pdf.
Hagen, R et al. , "Removal of Sparse-excitation artifacts in CELP," Proc. ICASSP, May 1998. vol. 1, pp. 145-148, xp010279147.
Harma, A. et al.: "A comparison of warped and conventional linear predictive coding," 11 pages. Last accessed Dec. 15, 2006 at http://www.acoustics.hut.fi/~aqi/wwwPhD/P8.PDF. (IEEE Trans. Speech Audio Proc., vol. 9, No. 5, Jul. 2001, pp. 579-588.
His-Wen Nein et al: "Incorporating Error Shaping Technique into LSF Vector Quantization" IEEE Transactions on Speech and Audio Processing, IEEE Service Center, vol. 9, No. 2, Feb. 2001 XP011054076 ISSN: 1063-6676.
International Telecommunications Union, ("ITU-T"), Series G: Transmission Systems and Media, Digital Systems and Networks, Digital transmission systems—-Terminal equipments—Coding of analogue signals by method other than PCM coding of speech at 8 Kbits/s using conjugate-structure algebraic code—Excited linear-Prediction CS-ACELP, Annex E: 11.8 Kbits/s CS ACELP Speech Coding algorithm, Sep. 1998.
Jelinek, M. et a.: "Noise reduction method for wideband speech coding," Euro. Sig. Proc. Conf., Vienna, Austria, Sep. 2004, pp. 1959-1962.
Kim, A. et al.: Improving the rate-distribution performance of DPCM. Proc 7th ISSPA, Paris, FR, Jul. 2003. pp. 97-100.
Kleijn, W. Bastiaan, et al., "The RCELP Speech-Coding Algorithm," European Transactions on Telecommunications and Related Technologies, Sep.-Oct. 1994, pp. 39-48, vol. 5, No. 5, Milano, IT XP000470678.
Knagenhjelm, P. H. and Kleijn, W. B., "Spectral dynamics is more important than spectral distortion," Proc. IEEE Int. Conf. on Acoustic Speech and Signal Processing, 1995, pp. 732-735.
Koishida, K. et al. A 16-kbit/s bandwidth scalable audio coder based on the G. 729 standard. Proc. ICASSP, Istanbul, Jun. 200, 4 pp. (vol. 2, pp. 1149-1152).
Lahouti, F. et al. Single and Double Frame Coding of Speech LPC Parameters Using a Lattice-based Quantization Scheme. (Tech. Rpt. UW-E&CE#2004-10, Univ, of Waterloo, ON, Apr. 2004. 22 pp.
Lahouti, F. et al. Single and Double Frame Coding of Speech LPC Parameters Using a Lattice-based Quantization Scheme. IEEE Trans. Audio, Speech, and Lang. Proc., 9pp. (Preprint of vol. 14, No. 5, Sep. 2006, pp. 1624-1632.
Makhoul, J. and Berouti, M., "High Frequency Regeneration in Speech Coding Systems," Proc. IEEE Int. Conf. on Acoustic Speech and Signal Processing, Washington, 1979, pp. 428-431.
Makinen, J et al.: "The Effect of Source Based Rate Adaptation Extension in AMR-WB Speech Codec" Speech Coding. 2002. IEE Workshop Proceedings, Oct. 6-9, 2002, Piscataway, NJ, USA, IEEE, Oct. 6, 2002, pp. 153-155.
McCree, A. et al. A 1.7 kb/s MELP coder with improved analysis and quantization. 4 pp. (Proc. ICASSP, Seattle, WA, May 1998, pp. 593-596.
McCree, Alan, et al., An Embedded Adaptive Multi-Rate Wideband Speech Coder, IEEE International Conference on Acoustics, Speech, and Signal Processing, May 7-11, 2001, pp. 761-764, vol. 1 of 6.
Nilsson M et al.: "Avoiding Over-Estimation in Bandwidth Extension of Telephony Speech" 2001 IEEE International Confeence on Acoustics, Speech, and Signal Processing. Proceedings (ICASSP). Salt Lake City, UT, May 7-11, 2001, IEEE International Conference on Acoustics, Speech, and Signal Processing. (May 7, 2001), pp. 869-872.
Nilsson, M., Andersen, S.V., Kleijn, W.,B., "Gaussian Mixture Model based Mutual Information Estimation between Frequency Based in Speech," Proc. IEEE Int. Conf. on Acoustic Speech and Signal Processing, Florida, 2002, pp. 525-528.
Noise shaping (Wikipedia entry). 3 pages. Last accessed Dec. 15, 2006 at http://en.wikipedia.org/wiki/Noise_shaping.
Nomura. T., et al.,"A bitrate and bandwidth scalable CELP coder," Acoustics, Speech and Signal Processing, May 1998, vol. 1, pp. 341-344, XP010279059.
Nordon, F. et al.: "A speech spectrum distortion measure with interframe memory." 4 pages (Proc. ICASSP, Salt Lake City, UT, May 2001, vol. 2.).
P.P. Vaidyanathan, Multirate Digital Filters, Filler Banks, Polyphase Networks, and Applications: A Tutorial, Proceedings of the IEEE, XP 000125845. Jan. 1990, pp. 56-93, vol. 78, No. 1.
Pereira, W. et al. Improved spectral tracking using interpolated linear prediction parameters. PRC. ICASSP, Orlando FL, May 2002, pp. I-261-I-264.
Postel, Jon. ed., Internet protocol, Request for Comments (Standard) RFC 791, Internet Engineering Task Force, Sep. 1981. (Obsoletes RFC 760), URL: http://www.ietf.org/rfc/rfc791.txt.
Qian, Y et al.: Classified Highband Excitation for Bandwidth Extension of Telephony Signals. Proc. Euro. Sig. proc. Conf. Anatalya, Turkey, Sep. 2005. 4 pages.
Ramachandran, R. et al. Pitch Prediction Filters in Speech Coding. IEEE Trans. Acoustics, Speech, and Sig. Proc., vol. 37, No. 4, Apr. 1989, pp. 467-478.
Roy, G. Low-rate analysis-by-synthesis wideband speech coding. MS thesis, McGrill Univ., Montreal, QC, Aug. 1990. Cover, ch. 3 (pp. 19-38, and ch. 6 (pp. 87-91).
Samuelsson, J. et al. Controlling Spectral Dynamics in LPC Quantization for Perceptual Enhancement. 5 pp. (Proc. 31st Asilomar Conf. Sig. Syst. Comp., 1997, pp. 1066-1070.
Tammi, Mikko, et al., "Coding Distortion Caused by a Phase Difference Between the LP Filter and its Residual," IEEE, 1999, pp. 102-104, XP10345571A.

The CCITT G. 722 Wideband Speech Coding Standard 3 pp. Last Accessed Dec. 15, 2006 at http://www.umiacs.Umd.edu/users/desin/Speech/mode3.html.
TS 26.090 v2.0.0. Mandatory Speech Codec speech processing functions. Jun. 1999. Cover, section 6, pp. 37-41, and figure 4, p. 49. p. 7.
Universal Mobile Telecommunications System (UMTS); audio codec processing functions; Extended Adaptive Multi-Rate-Wideband (AMR-WB+) code; Transcoding functions (3GPP TS 26.290 version 6.2.0 release 6); ETSI TS 126 290, ETSI Standards, European Telecommunication Standards Institute, vol. 3-SA4, No. v620. Mar. 2005, pp. 1-86.
Valin, J.-M., Lefebvre, R., "Bandwidth Extension of Narrowband Speech for Low Bit-Rate Wideband Coding," Proc. IEEE Speech Coding Workshop (SCW), 2000, pp. 130-132.
Wideband Speech Coding Standards and Applications. VolceAge Whitepaper. 17 pp. Last accessed Dec. 15, 2006 at http://www.voiceage.com/media/WidebandSpeech.pdf.
Doser, A., et al., Time Frequency Techniques for Signal Feature Detection. IEEE, XP010374021, Oct. 24, 1999, pp. 452-456, vol. 1. Thirty-Third Asilomar Conference, Piscataway, New Jersey.
Massimo Gregorio Muzzi, Amelioration d'un codeur parametrique. Rapport Du Stage, XP002388943, Jul. 2003, pp. 1-76.
Anonymous: "Noise Shaping," Wikipedia, Dec. 5, 2004, XP002387163, Retrieved Online: <http://www.wikipedia.org/>.
Normura et al., "A bitrate and bandwidth scalable CELP coder." Proceedings of the 1998 IEEE ICASSP, vol. 1,pp. 341-344, May 12, 1998.
Cabral, "Evaluation of Methods for Excitation Regeneration in Bandwidth Extension of Speech", Master thesis, KTH, sweden, Mar. 27, 2003.
Hsu, "Robust bandwidth extension of narrowband speech", McGill University, Canada. Nov. 2004.
Normura et al., "A bitrate and bandwidth scalable CELP coder," Proceedings of the 1998 IEEE ICASSP, vol. 1, pp. 341-344, May 12, 1998.
Kim, Jusub. "Filter Bank Design and Subband Coding," (Project 1 Report), University of Maryland, Retrieved Online: <http://www.ece.umd.edu/class/enee624.S2003/ENEE624jusub.pdf>, pp. 1-26, published Mar. 31, 2003.
"Signal Processing Toolbox: For Use with MATLAB User's Guide," ver. 4.2, Published by The Math Works Inc., Jan. 1999.

* cited by examiner

SYSTEMS, METHODS, AND APPARATUS FOR HIGHBAND BURST SUPPRESSION

RELATED APPLICATIONS

This application claims benefit of U.S. Provisional Pat. Appl. No. 60/667,901, entitled "CODING THE HIGH-FREQUENCY BAND OF WIDEBAND SPEECH," filed Apr. 1, 2005. This application also claims benefit of U.S. Provisional Pat. Appl. No. 60/673,965, entitled "PARAMETER CODING IN A HIGH-BAND SPEECH CODER," filed Apr. 22, 2005.

This application is also related to the following patent applications filed herewith: "SYSTEMS, METHODS, AND APPARATUS FOR WIDEBAND SPEECH CODING," Ser. No. 11/397,794; "SYSTEMS, METHODS, AND APPARATUS FOR HIGHBAND EXCITATION GENERATION," Ser. No. 11/397,870; "SYSTEMS, METHODS, AND APPARATUS FOR ANTI-SPARSENESS FILTERING," Ser. No. 11/397,505; "SYSTEMS, METHODS, AND APPARATUS FOR GAIN CODING," Ser. No. 11/397,871; "SYSTEMS, METHODS, AND APPARATUS FOR HIGHBAND TIME WARPING," Ser. No. 11/397,370; "SYSTEMS, METHODS, AND APPARATUS FOR SPEECH SIGNAL FILTERING," Ser. No. 11/397,432; and "SYSTEMS, METHODS, AND APPARATUS FOR QUANTIZATION OF SPECTRAL ENVELOPE REPRESENTATION," Ser. No. 11/397,872.

FIELD OF THE INVENTION

This invention relates to signal processing.

BACKGROUND

Voice communications over the public switched telephone network (PSTN) have traditionally been limited in bandwidth to the frequency range of 300-3400 kHz. New networks for voice communications, such as cellular telephony and voice over IP (VoIP), may not have the same bandwidth limits, and it may be desirable to transmit and receive voice communications that include a wideband frequency range over such networks. For example, it may be desirable to support an audio frequency range that extends down to 50 Hz and/or up to 7 or 8 kHz. It may also be desirable to support other applications, such as high-quality audio or audio/video conferencing, that may have audio speech content in ranges outside the traditional PSTN limits.

Extension of the range supported by a speech coder into higher frequencies may improve intelligibility. For example, the information that differentiates fricatives such as 's' and 'f' is largely in the high frequencies. Highband extension may also improve other qualities of speech, such as presence. For example, even a voiced vowel may have spectral energy far above the PSTN limit.

In conducting research on wideband speech signals, the inventors have occasionally observed pulses of high energy, or "bursts", in the upper part of the spectrum. These highband bursts typically last only a few milliseconds (typically 2 milliseconds), with a maximum length of about 3 milliseconds, may span up to several kilohertz (kHz) in frequency, and occur apparently randomly during different types of speech sounds, both voiced and unvoiced. For some speakers, a highband burst may occur in every sentence, while for other speakers such bursts may not occur at all. While these events do not generally occur frequently, they do seem to be ubiquitous, as the inventors have found examples of them in wideband speech samples from several different databases and from several other sources.

Highband bursts have a wide frequency range but typically only occur in the higher band of the spectrum, such as the region from 3.5 to 7 kHz, and not in the lower band. For example, FIG. 1 shows a spectrogram of the word 'can'. In this wideband speech signal, a highband burst may be seen at 0.1 seconds extending across a wide frequency region around 6 kHz (in this figure, darker regions indicate higher intensity). It is possible that at least some highband bursts are generated by an interaction between the speaker's mouth and the microphone and/or are due to clicks emitted by the speaker's mouth during speech.

SUMMARY

A method of signal processing according to one embodiment includes processing a wideband speech signal to obtain a lowband speech signal and a highband speech signal; determining that a burst is present in a region of the highband speech signal; and determining that the burst is absent from a corresponding region of the lowband speech signal. The method also includes, based on determining that the burst is present and on determining that the burst is absent, attenuating the highband speech signal over the region.

An apparatus according to an embodiment includes a first burst detector configured to detect bursts in the lowband speech signal; a second burst detector configured to detect bursts in a corresponding highband speech signal; an attenuation control signal calculator configured to calculate an attenuation control signal according to a difference between outputs of the first and second burst detectors; and a gain control element configured to apply the attenuation control signal to the highband speech signal.

DETAILED DESCRIPTION

Unless expressly limited by its context, the term "calculating" is used herein to indicate any of its ordinary meanings, such as computing, generating, and selecting from a list of values. Where the term "comprising" is used in the present description and claims, it does not exclude other elements or operations.

Highband bursts are quite audible in the original speech signal, but they do not contribute to intelligibility, and the quality of the signal may be improved by suppressing them. Highband bursts may also be detrimental to encoding of the highband speech signal, such that efficiency of coding the signal, and especially of encoding the temporal envelope, may be improved by suppressing the bursts from the highband speech signal.

Highband bursts may negatively affect high-band coding systems in several ways. First, these bursts may cause the energy envelope of the speech signal over time to be much less smooth by introducing a sharp peak at the time of the burst. Unless the coder models the temporal envelope of the signal with high resolution, which increases the amount of information to be sent to the decoder, the energy of the burst may become smeared out over time in the decoded signal and cause artifacts. Second, highband bursts tend to dominate the spectral envelope as modeled by, for example, a set of parameters such as linear prediction filter coefficients. Such modeling is typically performed for each frame of the speech signal (about 20 milliseconds). Consequently, the frame containing the click may be synthesized according to a spectral envelope that is different from the preceding and following frames, which can lead to a perceptually objectionable discontinuity.

Highband bursts may cause another problem for a speech coding system in which an excitation signal for the highband synthesis filter is derived from or otherwise represents a narrowband residual. In such case, presence of a highband burst may complicate coding of the highband speech signal because the highband speech signal includes a structure that is absent from the narrowband speech signal.

Figure 1:
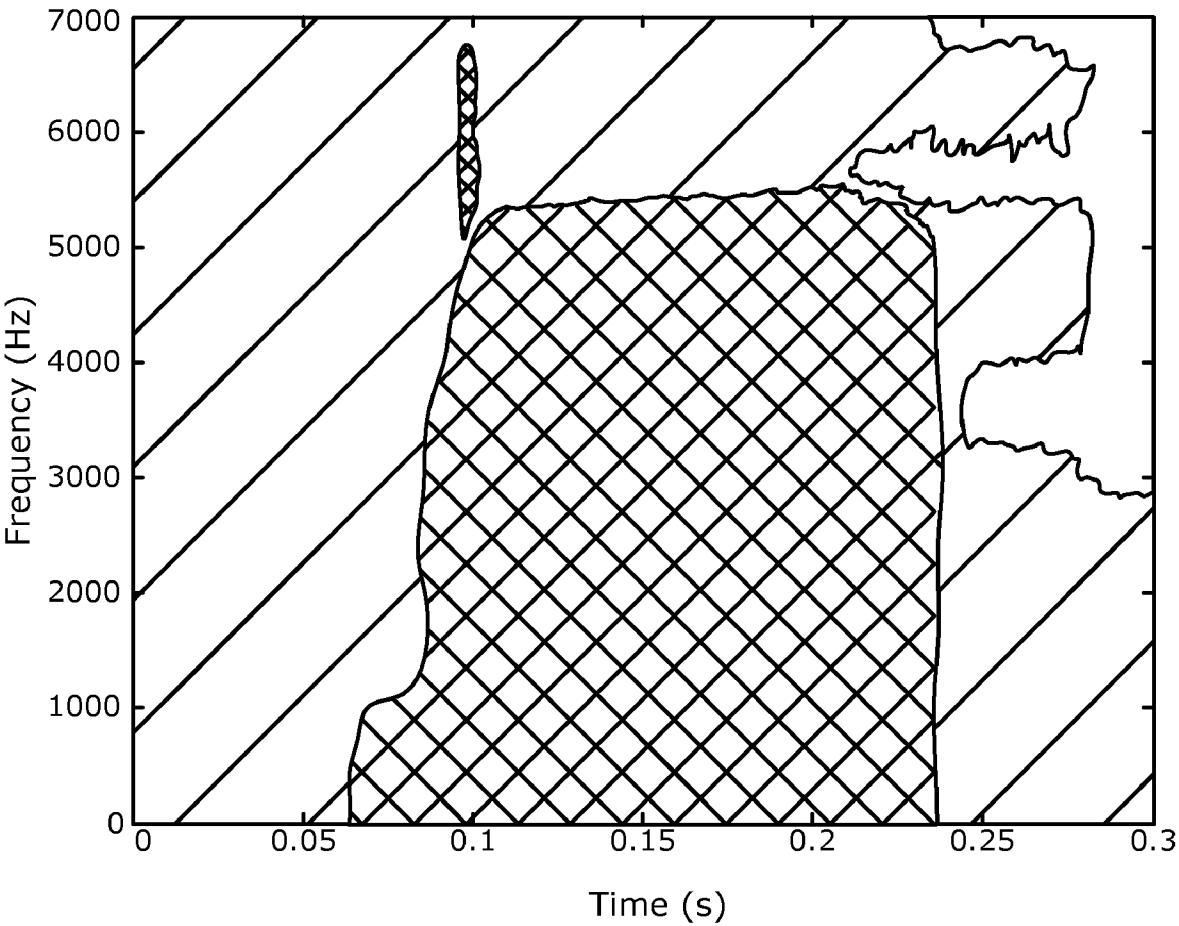
FIG. 1 shows a spectrogram of a signal including a highband burst.
Figure 2:
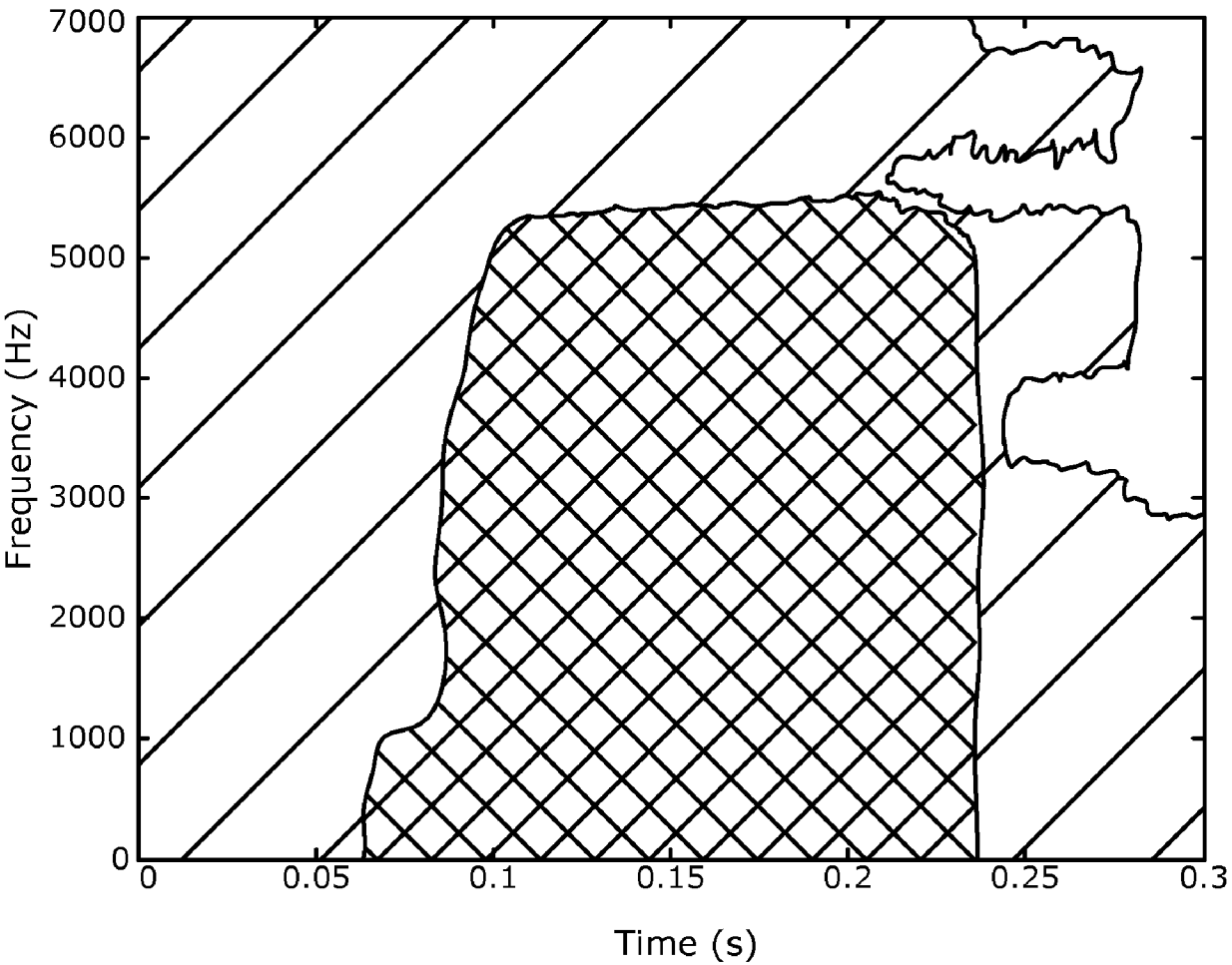
FIG. 2 shows a spectrogram of a signal in which a highband burst has been suppressed.

Embodiments include systems, methods, and apparatus configured to detect bursts that exist in a highband speech signal, but not in a corresponding lowband speech signal, and to reduce a level of the highband speech signal during each of the bursts. Potential advantages of such embodiments include avoiding artifacts in the decoded signal and/or avoiding a loss of coding efficiency without noticeably degrading the quality of the original signal. FIG. 2 shows a spectrogram of the wideband signal shown in FIG. 1 after suppression of the highband burst according to such a method.

Figure 3:
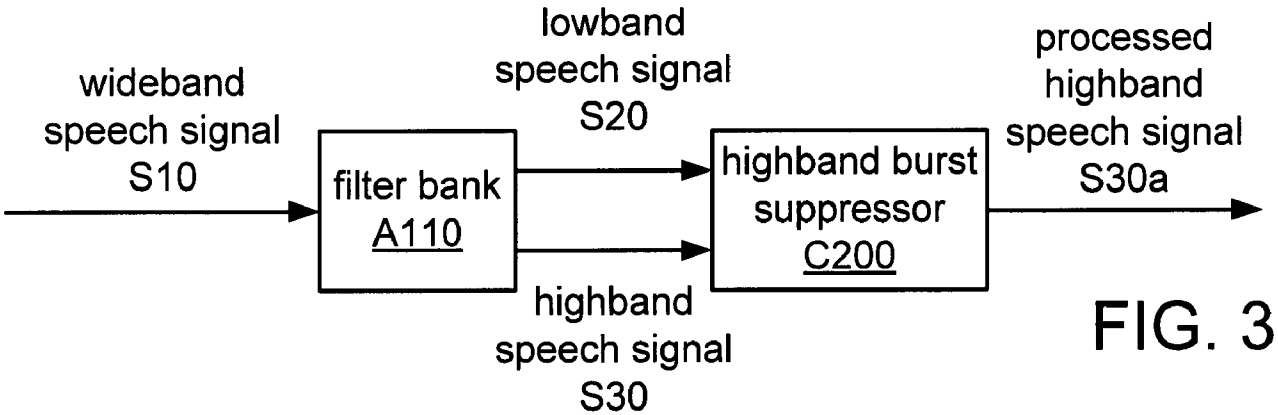
FIG. 3 shows a block diagram of an arrangement including a filter bank A110 and a highband burst suppressor C200 according to an embodiment.

FIG. 3 shows a block diagram of an arrangement including a filter bank A110 and a highband burst suppressor C200 according to an embodiment. Filter bank A110 is configured to filter wideband speech signal S10 to produce a lowband speech signal S20 and a highband speech signal S30. Highband burst suppressor C200 is configured to output a processed highband speech signal S30*a* based on highband speech signal S30, in which bursts that occur in highband speech signal S30 but are absent from lowband speech signal S20 have been suppressed.

Figure 4:
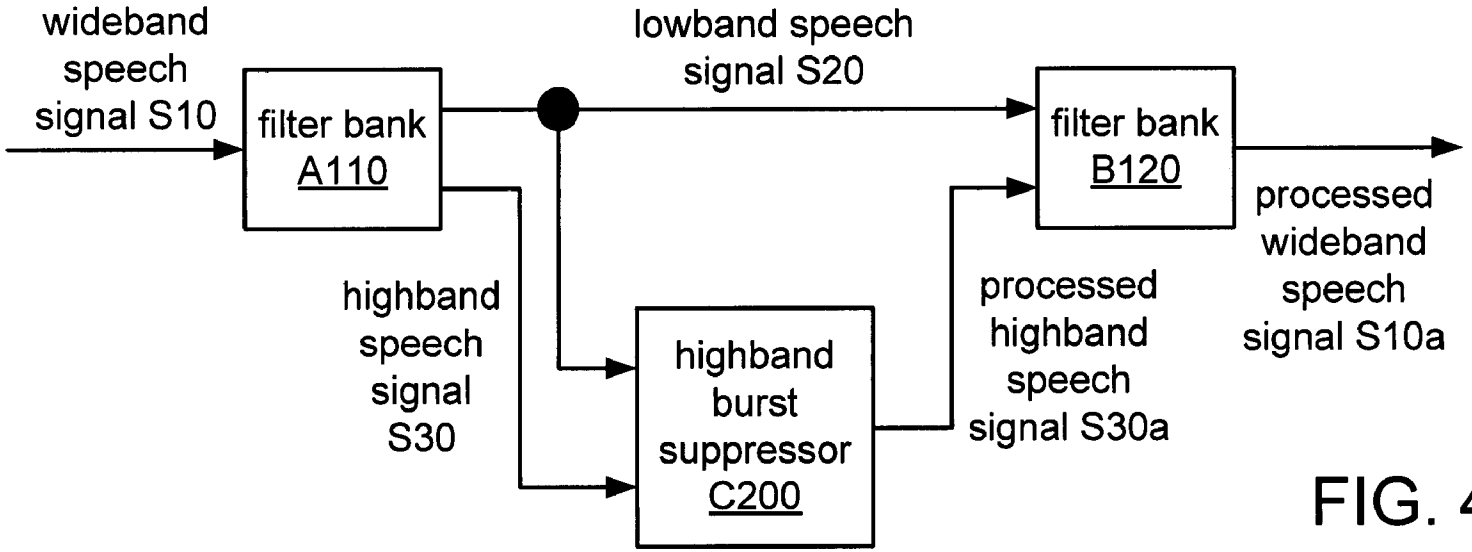
FIG. 4 shows a block diagram of an arrangement including filter bank A110, highband burst suppressor C200, and a filter bank B120.

FIG. 4 shows a block diagram of the arrangement shown in FIG. 3 that also includes a filter bank B120. Filter bank B120 is configured to combine lowband speech signal S20 and processed highband speech signal S30*a* to produce a processed wideband speech signal S10*a*. The quality of processed wideband speech signal S10*a* may be improved over that of wideband speech signal S10 due to suppression of highband bursts.

Filter bank A110 is configured to filter an input signal according to a split-band scheme to produce a low-frequency subband and a high-frequency subband. Depending on the design criteria for the particular application, the output subbands may have equal or unequal bandwidths and may be overlapping or nonoverlapping. A configuration of filter bank A110 that produces more than two subbands is also possible. For example, such a filter bank may be configured to produce a very-low-band signal that includes components in a frequency range below that of narrowband signal S20 (such as the range of 50-300 Hz). In such case, wideband speech encoder A100 (as introduced with reference to FIG. 8 below) may be implemented to encode this very-low-band signal separately, and multiplexer A130 (as introduced with reference to FIG. 11 below) may be configured to include the encoded very-low-band signal in multiplexed signal S70 (e.g., as a separable portion).

Figure 5A:
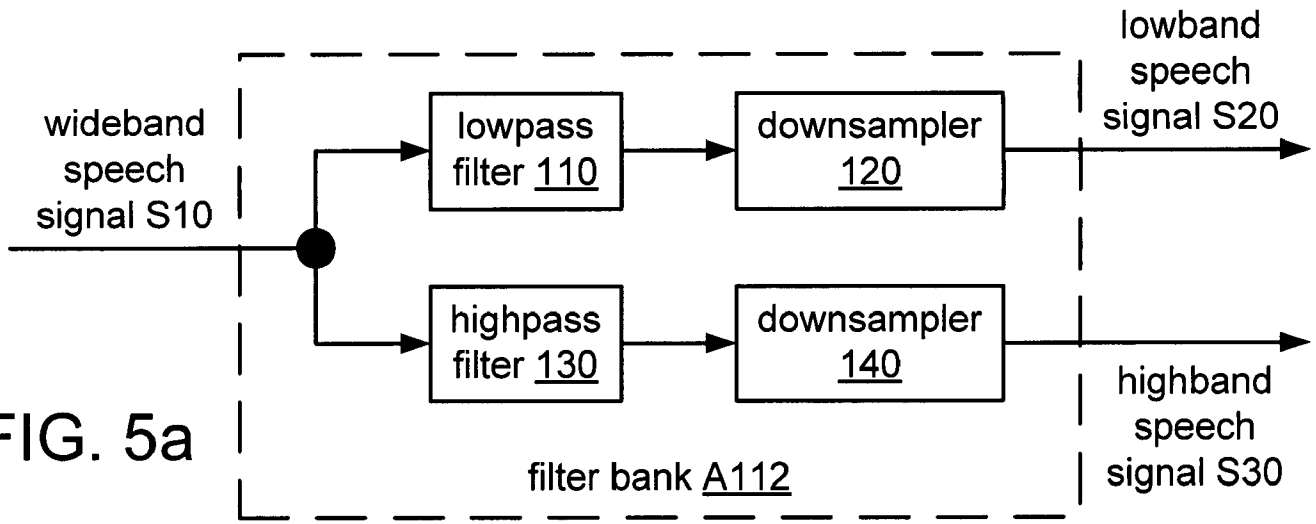
FIG. 5*a* shows a block diagram of an implementation A112 of filter bank A110.

FIG. 5*a* shows a block diagram of an implementation A112 of filter bank A110 that is configured to produce two subband signals having reduced sampling rates. Filter bank A110 is arranged to receive a wideband speech signal S10 having a high-frequency (or highband) portion and a low-frequency (or lowband) portion. Filter bank A112 includes a lowband processing path configured to receive wideband speech signal S10 and to produce narrowband speech signal S20, and a highband processing path configured to receive wideband speech signal S10 and to produce highband speech signal S30. Lowpass filter 110 filters wideband speech signal S10 to pass a selected low-frequency subband, and highpass filter 130 filters wideband speech signal S10 to pass a selected high-frequency subband. Because both subband signals have more narrow bandwidths than wideband speech signal S10, their sampling rates can be reduced to some extent without loss of information. Downsampler 120 reduces the sampling rate of the lowpass signal according to a desired decimation factor (e.g., by removing samples of the signal and/or replacing samples with average values), and downsampler 140 likewise reduces the sampling rate of the highpass signal according to another desired decimation factor.

Figure 5B:
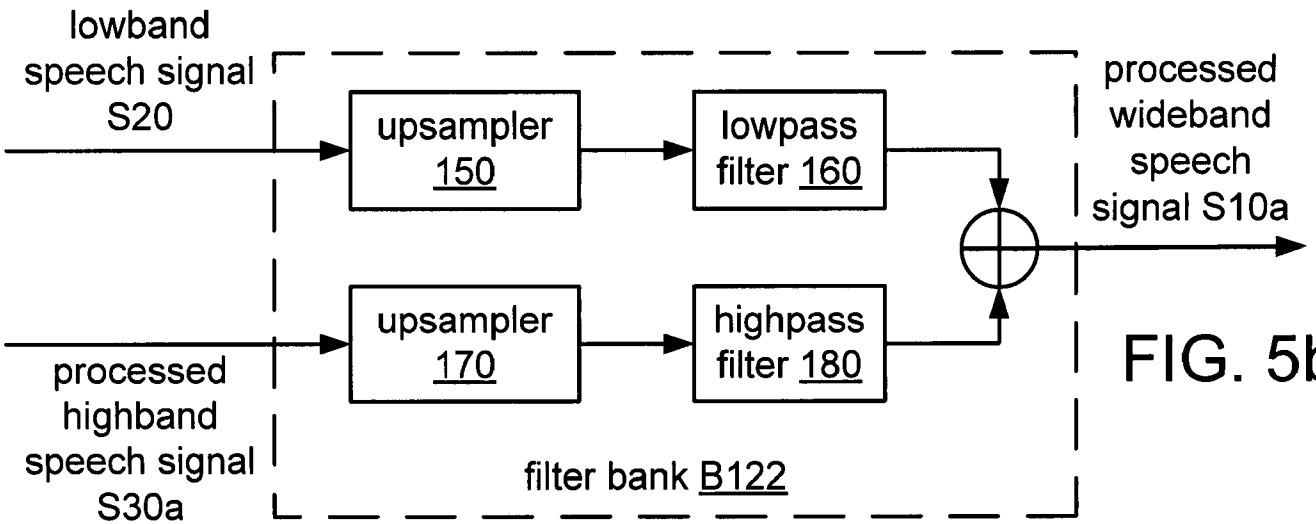
FIG. 5*b* shows a block diagram of an implementation B122 of filter bank B120.

FIG. 5*b* shows a block diagram of a corresponding implementation B122 of filter bank B120. Upsampler 150 increases the sampling rate of lowband speech signal S20 (e.g., by zero-stuffing and/or by duplicating samples), and lowpass filter 160 filters the upsampled signal to pass only a lowband portion (e.g., to prevent aliasing). Likewise, upsampler 170 increases the sampling rate of processed highband signal S30*a* and highpass filter 180 filters the upsampled signal to pass only a highband portion. The two passband signals are then summed to form wideband speech signal S10*a*. In some implementations of an apparatus that includes filter bank B120, filter bank B120 is configured to produce a weighted sum of the two passband signals according to one or more weights received and/or calculated by the apparatus. A configuration of filter bank B120 that combines more than two passband signals is also contemplated.

Each of the filters 110, 130, 160, 180 may be implemented as a finite-impulse-response (FIR) filter or as an infinite-impulse-response (IIR) filter. The frequency responses of filters 110 and 130 may have symmetric or dissimilarly shaped transition regions between stopband and passband. Likewise, the frequency responses of filters 160 and 180 may have symmetric or dissimilarly shaped transition regions between stopband and passband. It may be desirable but is not strictly necessary for lowpass filter 110 to have the same response as lowpass filter 160, and for highpass filter 130 to have the same response as highpass filter 180. In one example, the two filter pairs 110, 130 and 160, 180 are quadrature mirror filter (QMF) banks, with filter pair 110, 130 having the same coefficients as filter pair 160, 180.

Figure 6B:
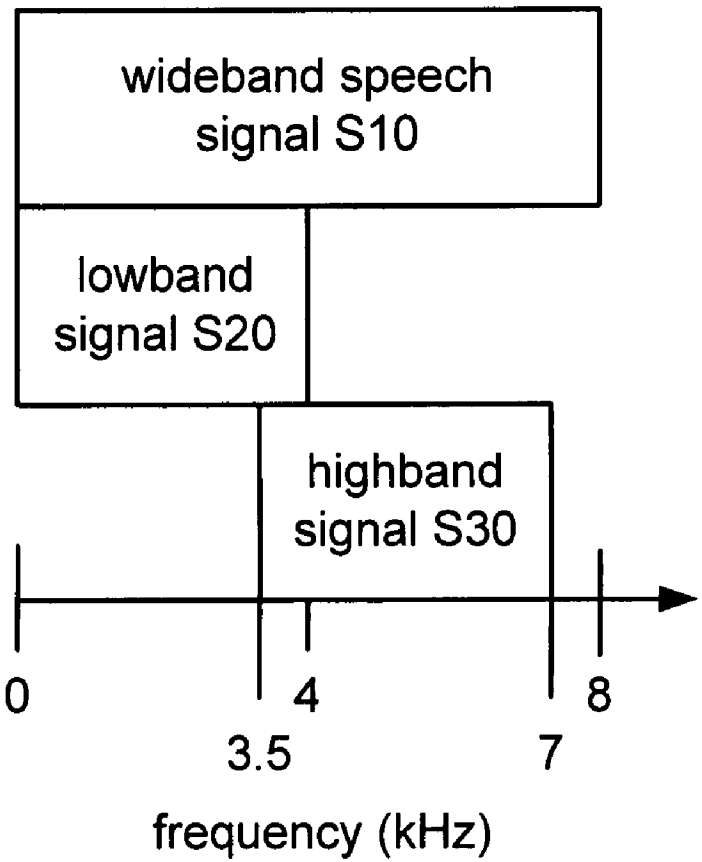
FIG. 6*b* shows bandwidth coverage of the low and high bands for another example of filter bank A110.
Figure 6A:
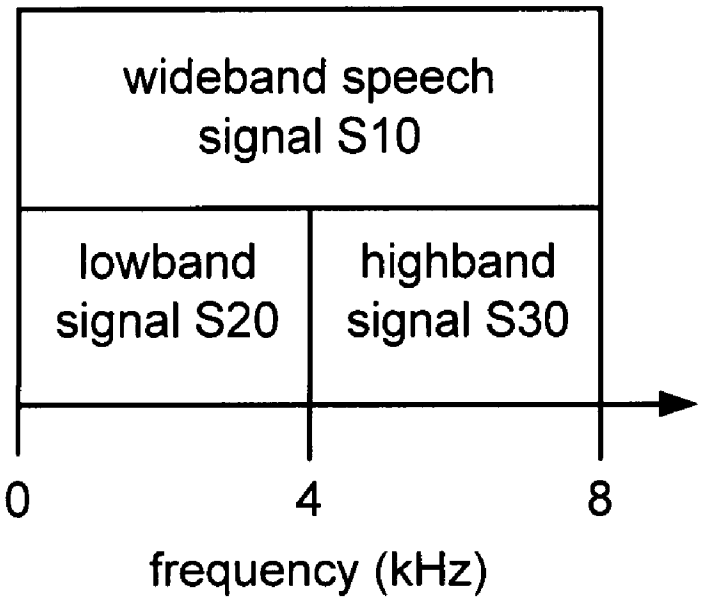
FIG. 6*a* shows bandwidth coverage of the low and high bands for one example of filter bank A110.

In a typical example, lowpass filter 110 has a passband that includes the limited PSTN range of 300-3400 Hz (e.g., the band from 0 to 4 kHz). FIGS. 6*a* and 6*b* show relative bandwidths of wideband speech signal S10, lowband speech signal S20, and highband speech signal S30 in two different implementational examples. In both of these particular examples, wideband speech signal S10 has a sampling rate of 16 kHz (representing frequency components within the range of 0 to 8 kHz), and lowband signal S20 has a sampling rate of 8 kHz (representing frequency components within the range of 0 to 4 kHz).

In the example of FIG. 6*a*, there is no significant overlap between the two subbands. A highband signal S30 as shown in this example may be obtained using a highpass filter 130 with a passband of 4-8 kHz. In such a case, it may be desirable to reduce the sampling rate to 8 kHz by downsampling the filtered signal by a factor of two. Such an operation, which may be expected to significantly reduce the computational complexity of further processing operations on the signal, will move the passband energy down to the range of 0 to 4 kHz without loss of information.

In the alternative example of FIG. 6*b*, the upper and lower subbands have an appreciable overlap, such that the region of 3.5 to 4 kHz is described by both subband signals. A highband signal S30 as in this example may be obtained using a highpass filter 130 with a passband of 3.5-7 kHz. In such a case, it may be desirable to reduce the sampling rate to 7 kHz by downsampling the filtered signal by a factor of 16/7. Such an operation, which may be expected to significantly reduce the computational complexity of further processing operations on the signal, will move the passband energy down to the range of 0 to 3.5 kHz without loss of information.

In a typical handset for telephonic communication, one or more of the transducers (i.e., the microphone and the earpiece or loudspeaker) lacks an appreciable response over the frequency range of 7-8 kHz. In the example of FIG. 6*b*, the portion of wideband speech signal S10 between 7 and 8 kHz is not included in the encoded signal. Other particular examples of highpass filter 130 have passbands of 3.5-7.5 kHz and 3.5-8 kHz.

In some implementations, providing an overlap between subbands as in the example of FIG. 6*b* allows for the use of a lowpass and/or a highpass filter having a smooth rolloff over the overlapped region. Such filters are typically less computationally complex and/or introduce less delay than filters with sharper or "brick-wall" responses. Filters having sharp transition regions tend to have higher sidelobes (which may cause aliasing) than filters of similar order that have smooth rolloffs. Filters having sharp transition regions may also have long impulse responses which may cause ringing artifacts. For filter bank implementations having one or more IIR filters, allowing for a smooth rolloff over the overlapped region may enable the use of a filter or filters whose poles are farther away from the unit circle, which may be important to ensure a stable fixed-point implementation.

Overlapping of subbands allows a smooth blending of lowband and highband that may lead to fewer audible artifacts, reduced aliasing, and/or a less noticeable transition from one band to the other. Moreover, in an application where the lowband and highband speech signals S20, S30 are subsequently encoded by different speech encoders, the coding efficiency of the lowband speech encoder (for example, a waveform coder) may drop with increasing frequency. For example, coding quality of the lowband speech coder may be reduced at low bit rates, especially in the presence of background noise. In such cases, providing an overlap of the subbands may increase the quality of reproduced frequency components in the overlapped region.

Moreover, overlapping of subbands allows a smooth blending of lowband and highband that may lead to fewer audible artifacts, reduced aliasing, and/or a less noticeable transition from one band to the other. Such a feature may be especially desirable for an implementation in which lowband speech encoder A120 and highband speech encoder A200 as discussed below operate according to different coding methodologies. For example, different coding techniques may produce signals that sound quite different. A coder that encodes a spectral envelope in the form of codebook indices may produce a signal having a different sound than a coder that encodes the amplitude spectrum instead. A time-domain coder (e.g., a pulse-code-modulation or PCM coder) may produce a signal having a different sound than a frequency-domain coder. A coder that encodes a signal with a representation of the spectral envelope and the corresponding residual signal may produce a signal having a different sound than a coder that encodes a signal with only a representation of the spectral envelope. A coder that encodes a signal as a representation of its waveform may produce an output having a different sound than that from a sinusoidal coder. In such cases, using filters having sharp transition regions to define nonoverlapping subbands may lead to an abrupt and perceptually noticeable transition between the subbands in the synthesized wideband signal.

Although QMF filter banks having complementary overlapping frequency responses are often used in subband techniques, such filters are unsuitable for at least some of the wideband coding implementations described herein. A QMF filter bank at the encoder is configured to create a significant degree of aliasing that is canceled in the corresponding QMF filter bank at the decoder. Such an arrangement may not be appropriate for an application in which the signal incurs a significant amount of distortion between the filter banks, as the distortion may reduce the effectiveness of the alias cancellation property. For example, applications described herein include coding implementations configured to operate at very low bit rates. As a consequence of the very low bit rate, the decoded signal is likely to appear significantly distorted as compared to the original signal, such that use of QMF filter banks may lead to uncanceled aliasing. Applications that use QMF filter banks typically have higher bit rates (e.g., over 12 kbps for AMR, and 64 kbps for G.722).

Additionally, a coder may be configured to produce a synthesized signal that is perceptually similar to the original signal but which actually differs significantly from the original signal. For example, a coder that derives the highband excitation from the narrowband residual as described herein may produce such a signal, as the actual highband residual may be completely absent from the decoded signal. Use of QMF filter banks in such applications may lead to a significant degree of distortion caused by uncanceled aliasing.

The amount of distortion caused by QMF aliasing may be reduced if the affected subband is narrow, as the effect of the aliasing is limited to a bandwidth equal to the width of the subband. For examples as described herein in which each subband includes about half of the wideband bandwidth, however, distortion caused by uncanceled aliasing could affect a significant part of the signal. The quality of the signal may also be affected by the location of the frequency band over which the uncanceled aliasing occurs. For example, distortion created near the center of a wideband speech signal (e.g., between 3 and 4 kHz) may be much more objectionable than distortion that occurs near an edge of the signal (e.g., above 6 kHz).

While the responses of the filters of a QMF filter bank are strictly related to one another, the lowband and highband paths of filter banks A110 and B120 may be configured to have spectra that are completely unrelated apart from the overlapping of the two subbands. We define the overlap of the two subbands as the distance from the point at which the frequency response of the highband filter drops to −20 dB up to the point at which the frequency response of the lowband filter drops to −20 dB. In various examples of filter bank A110 and/or B120, this overlap ranges from around 200 Hz to around 1 kHz. The range of about 400 to about 600 Hz may represent a desirable tradeoff between coding efficiency and perceptual smoothness. In one particular example as mentioned above, the overlap is around 500 Hz.

Figure 6C:
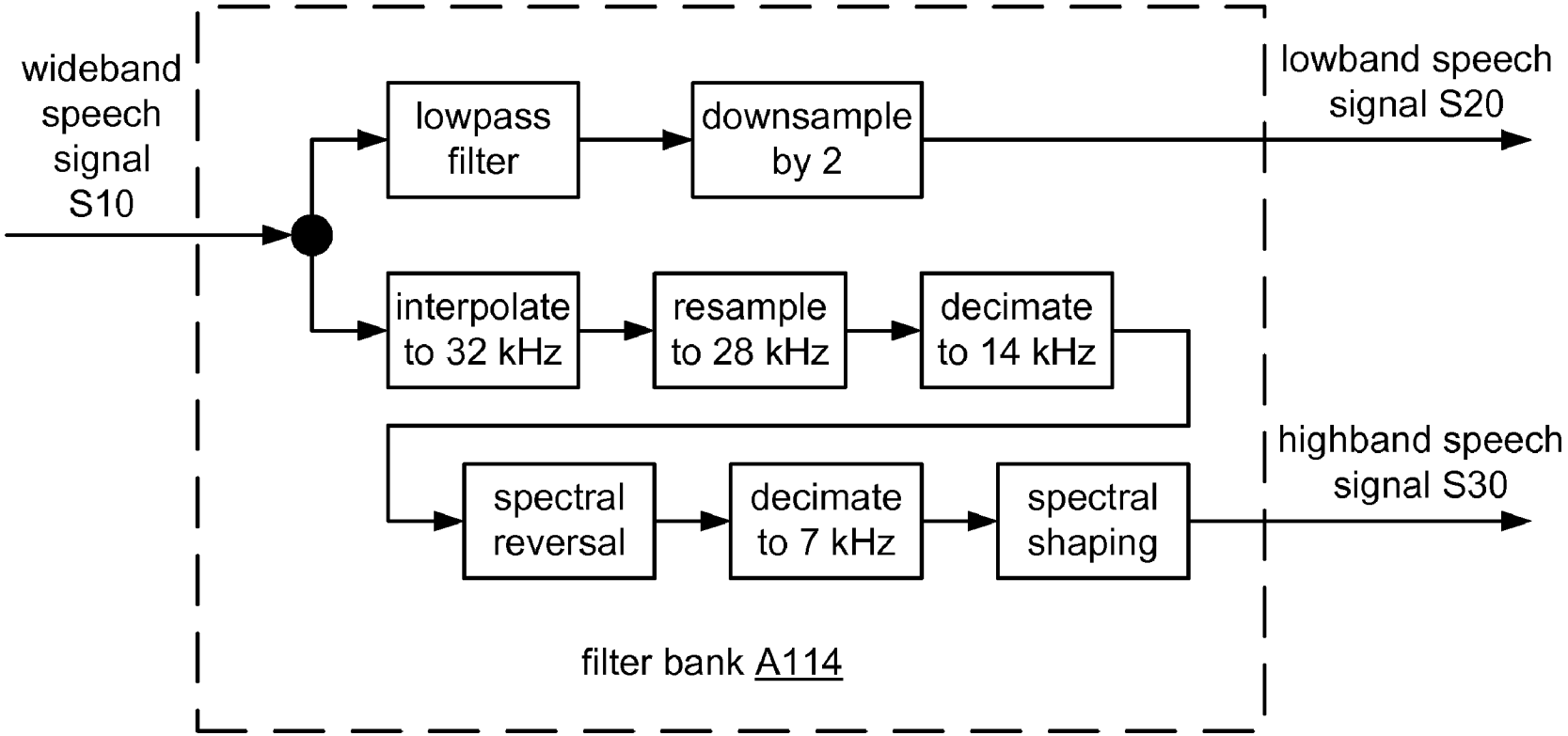
FIG. 6*c* shows a block diagram of an implementation A114 of filter bank A112.

It may be desirable to implement filter bank A112 and/or B122 to perform operations as illustrated in FIGS. 6*a* and 6*b* in several stages. For example, FIG. 6*c* shows a block diagram of an implementation A114 of filter bank A112 that performs a functional equivalent of highpass filtering and downsampling operations using a series of interpolation, resampling, decimation, and other operations. Such an implementation may be easier to design and/or may allow reuse of functional blocks of logic and/or code. For example, the same functional block may be used to perform the operations of decimation to 14 kHz and decimation to 7 kHz as shown in FIG. 6*c*. The spectral reversal operation may be implemented by multiplying the signal with the function $e^{jn\pi}$ or the sequence $(-1)^n$, whose values alternate between +1 and −1. The spectral shaping operation may be implemented as a lowpass filter configured to shape the signal to obtain a desired overall filter response.

It is noted that as a consequence of the spectral reversal operation, the spectrum of highband signal S30 is reversed. Subsequent operations in the encoder and corresponding decoder may be configured accordingly. For example, it may be desired to produce a corresponding excitation signal that also has a spectrally reversed form.

Figure 6D:
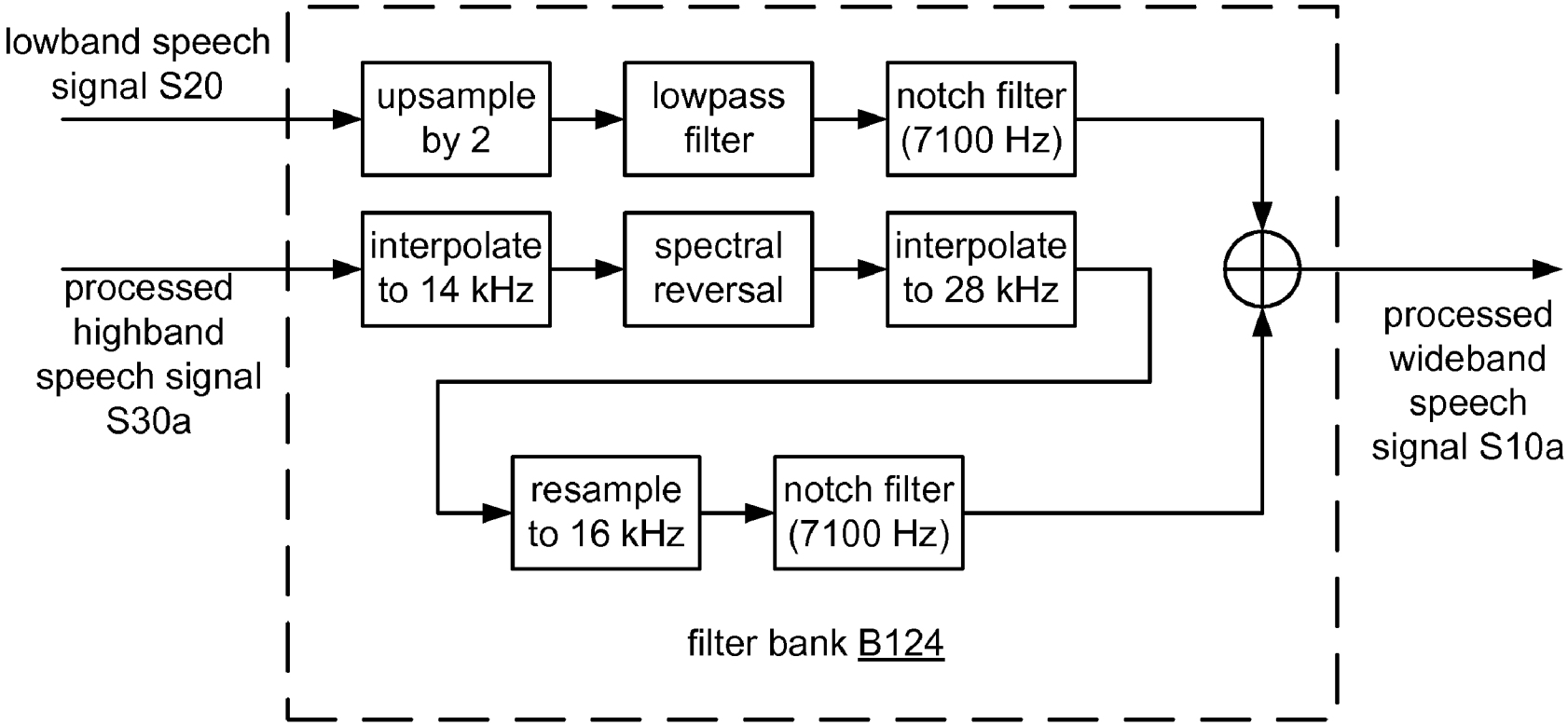
FIG. 6*d* shows a block diagram of an implementation B124 of filter bank B122.

FIG. 6*d* shows a block diagram of an implementation B124 of filter bank B122 that performs a functional equivalent of upsampling and highpass filtering operations using a series of interpolation, resampling, and other operations. Filter bank B124 includes a spectral reversal operation in the highband that reverses a similar operation as performed, for example, in a filter bank of the encoder such as filter bank A114. In this particular example, filter bank B124 also includes notch filters in the lowband and highband that attenuate a component of the signal at 7100 Hz, although such filters are optional and need not be included. The patent application "SYSTEMS, METHODS, AND APPARATUS FOR SPEECH SIGNAL FILTERING" filed herewith, Ser. No. 11/397,432, includes additional description and figures relating to responses of elements of particular implementations of filter banks A110 and B120, and this material is hereby incorporated by reference.

Figure 7:
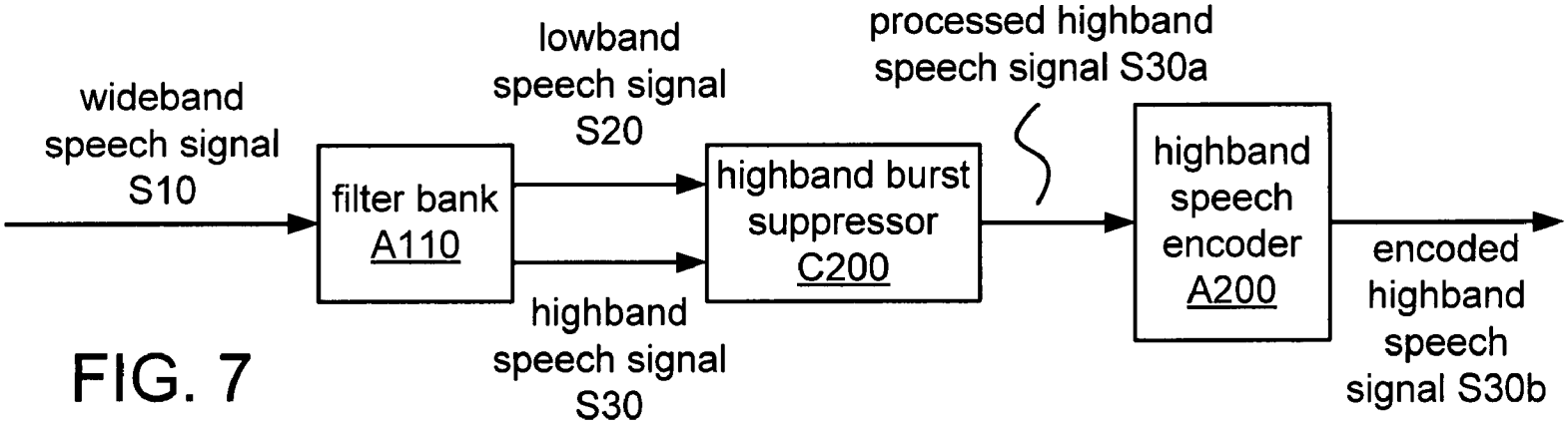
FIG. 7 shows a block diagram of an arrangement including filter bank A110, highband burst suppressor C200, and a highband speech encoder A200.

As noted above, highband burst suppression may improve the efficiency of coding highband speech signal S30. FIG. 7 shows a block diagram of an arrangement in which processed highband speech signal S30*a*, as produced by highband burst suppressor C200, is encoded by a highband speech encoder A200 to produce encoded highband speech signal S30*b*.

Figure 8:
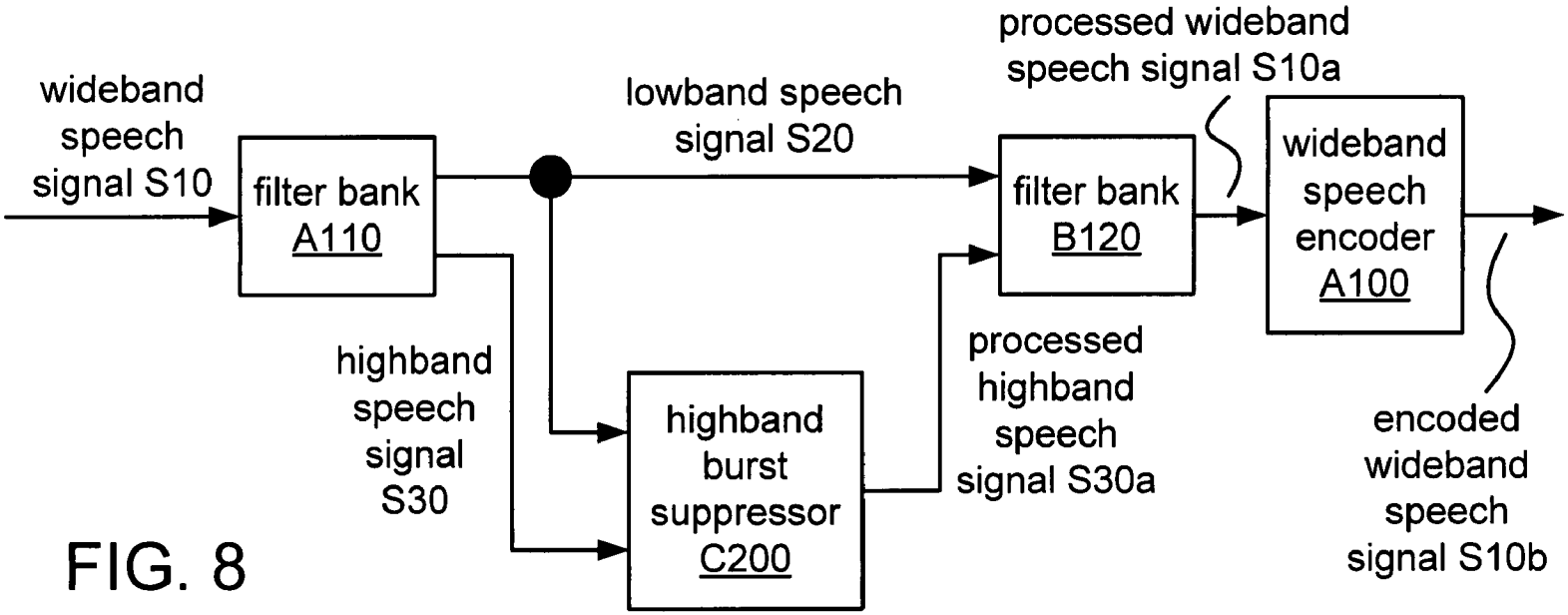
FIG. 8 shows a block diagram of an arrangement including filter bank A110, highband burst suppressor C200, filter bank B120, and a wideband speech encoder A100.

One approach to wideband speech coding involves scaling a narrowband speech coding technique (e.g., one configured to encode the range of 0-4 kHz) to cover the wideband spectrum. For example, a speech signal may be sampled at a higher rate to include components at high frequencies, and a narrowband coding technique may be reconfigured to use more filter coefficients to represent this wideband signal. FIG. 8 shows a block diagram of an example in which a wideband speech encoder A100 is arranged to encode processed wideband speech signal S10*a* to produce encoded wideband speech signal S10*b*.

Figure 9:
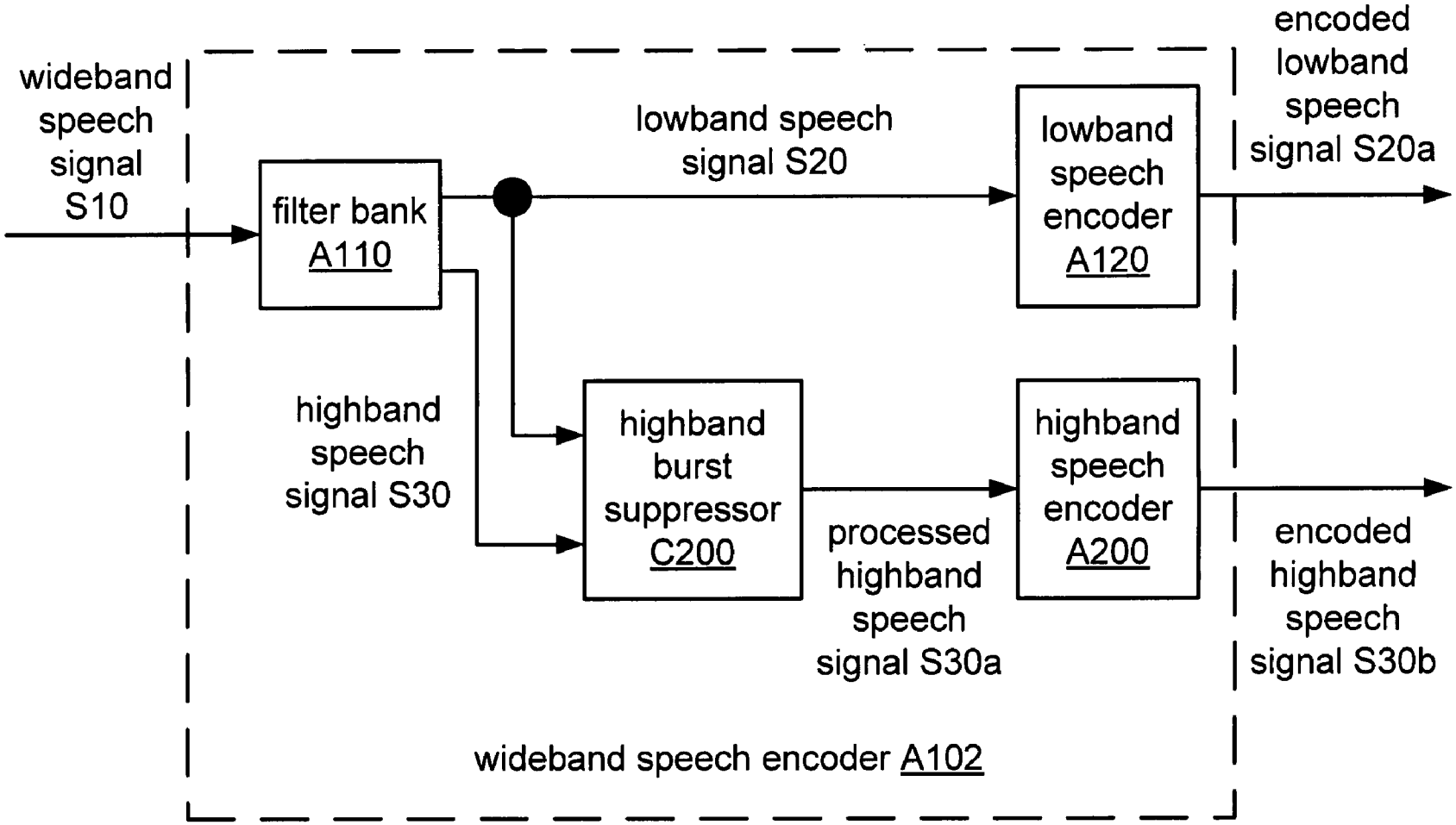
FIG. 9 shows a block diagram of a wideband speech encoder A102 that includes highband burst suppressor C200.

Narrowband coding techniques such as CELP (codebook excited linear prediction) are computationally intensive, however, and a wideband CELP coder may consume too many processing cycles to be practical for many mobile and other embedded applications. Encoding the entire spectrum of a wideband signal to a desired quality using such a technique may also lead to an unacceptably large increase in bandwidth. Moreover, transcoding of such an encoded signal would be required before even its narrowband portion could be transmitted into and/or decoded by a system that only supports narrowband coding. FIG. 9 shows a block diagram of a wideband speech encoder A102 that includes separate lowband and highband speech encoders A120 and A200, respectively.

It may be desirable to implement wideband speech coding such that at least the narrowband portion of the encoded signal may be sent through a narrowband channel (such as a PSTN channel) without transcoding or other significant modification. Efficiency of the wideband coding extension may also be desirable, for example, to avoid a significant reduction in the number of users that may be serviced in applications such as wireless cellular telephony and broadcasting over wired and wireless channels.

One approach to wideband speech coding involves extrapolating the highband spectral envelope from the encoded narrowband spectral envelope. While such an approach may be implemented without any increase in bandwidth and without a need for transcoding, however, the coarse spectral envelope or formant structure of the highband portion of a speech signal generally cannot be predicted accurately from the spectral envelope of the narrowband portion.

Figure 10:
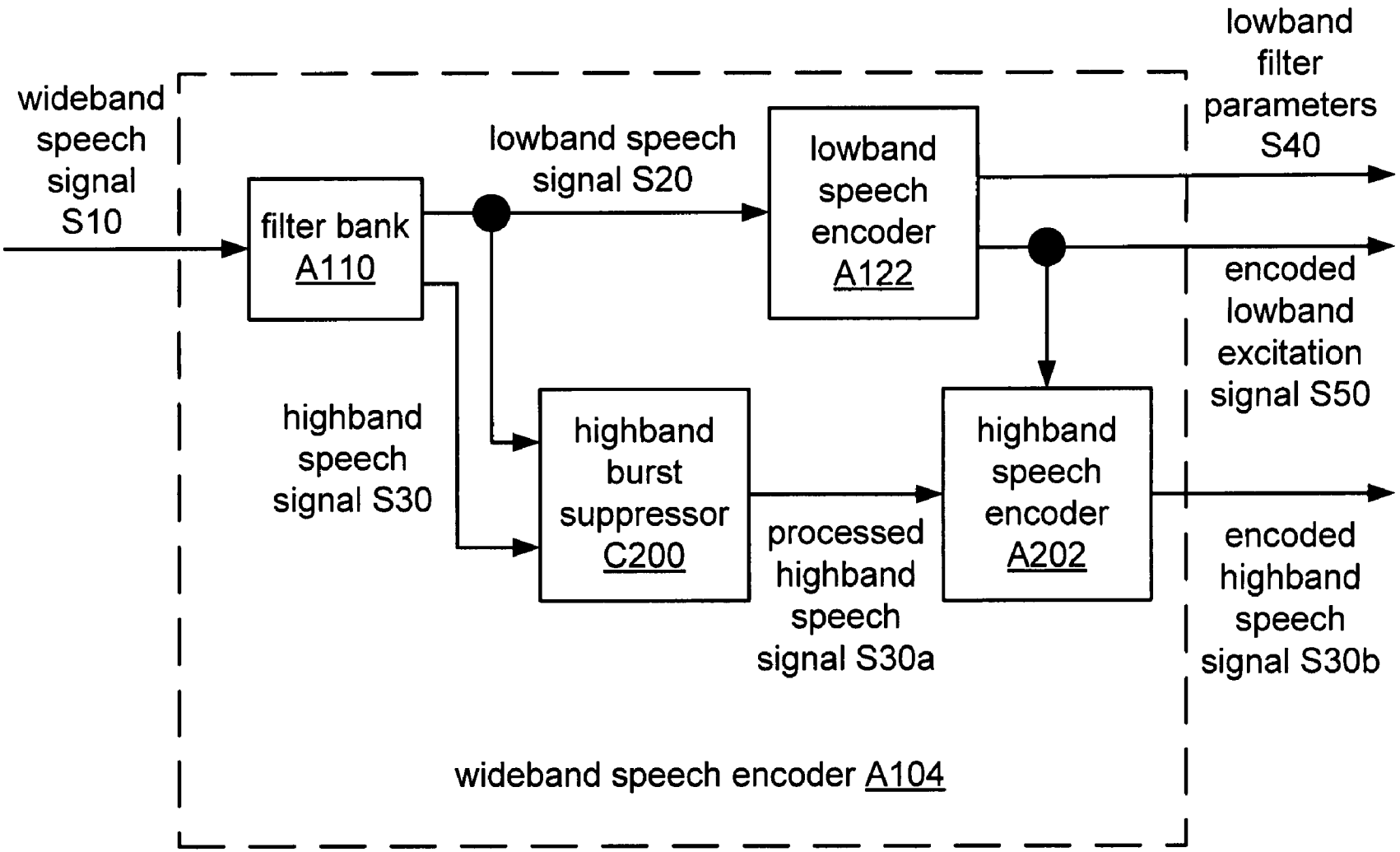
FIG. 10 shows a block diagram of an implementation A104 of wideband speech encoder A102.

FIG. 10 shows a block diagram of a wideband speech encoder A104 that uses another approach to encoding the highband speech signal according to information from the lowband speech signal. In this example, the highband excitation signal is derived from the encoded lowband excitation signal S50. Encoder A104 may be configured to encode a gain envelope based on a signal based on the highband excitation signal, for example, according to one or more such embodiments as described in the patent application "SYSTEMS, METHODS, AND APPARATUS FOR GAIN CODING" filed herewith, Ser. No. 11/397,871, which description is hereby incorporated by reference. One particular example of wideband speech encoder A104 is configured to encode wideband speech signal S10 at a rate of about 8.55 kbps (kilobits per second), with about 7.55 kbps being used for lowband filter parameters S40 and encoded lowband excitation signal S50, and about 1 kbps being used for encoded highband speech signal S30*b*.

Figure 11:
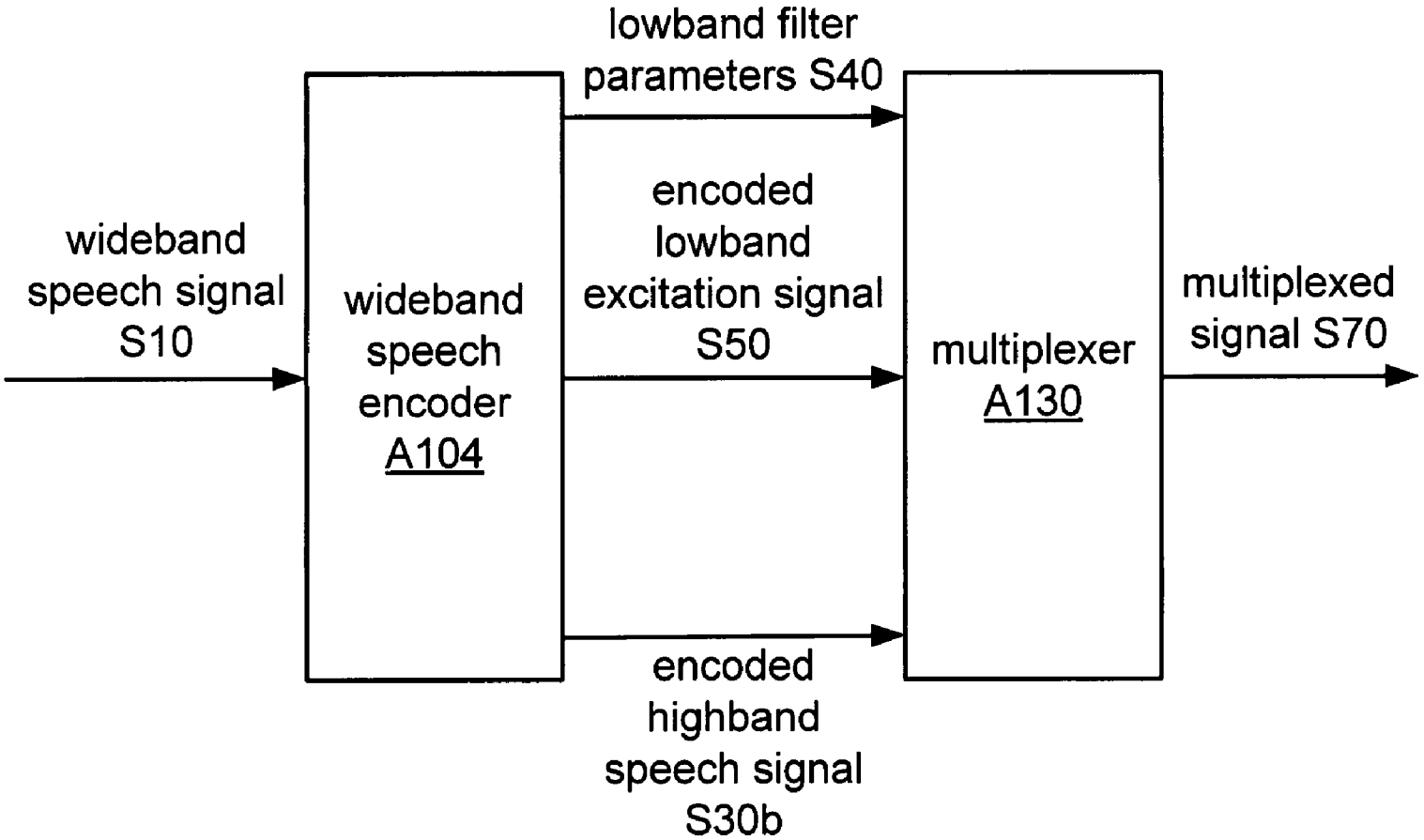
FIG. 11 shows a block diagram of an arrangement including wideband speech encoder A104 and a multiplexer A130.

It may be desired to combine the encoded lowband and highband signals into a single bitstream. For example, it may be desired to multiplex the encoded signals together for transmission (e.g., over a wired, optical, or wireless transmission channel), or for storage, as an encoded wideband speech signal. FIG. 11 shows a block diagram of an arrangement including wideband speech encoder A104 and a multiplexer A130 configured to combine lowband filter parameters S40, encoded lowband excitation signal S50, and encoded highband speech signal S30*b* into a multiplexed signal S70.

It may be desirable for multiplexer A130 to be configured to embed the encoded lowband signal (including lowband filter parameters S40 and encoded lowband excitation signal S50) as a separable substream of multiplexed signal S70, such that the encoded lowband signal may be recovered and decoded independently of another portion of multiplexed signal S70 such as a highband and/or very-low-band signal. For example, multiplexed signal S70 may be arranged such that the encoded lowband signal may be recovered by stripping away the encoded highband speech signal S30*b*. One potential advantage of such a feature is to avoid the need for transcoding the encoded wideband signal before passing it to a system that supports decoding of the lowband signal but does not support decoding of the highband portion.

An apparatus including a lowband, highband, and/or wideband speech encoder as described herein may also include circuitry configured to transmit the encoded signal into a transmission channel such as a wired, optical, or wireless channel. Such an apparatus may also be configured to perform one or more channel encoding operations on the signal, such as error correction encoding (e.g., rate-compatible convolutional encoding) and/or error detection encoding (e.g., cyclic redundancy encoding), and/or one or more layers of network protocol encoding (e.g., Ethernet, TCP/IP, cdma2000).

Any or all of the lowband, highband, and wideband speech encoders described herein may be implemented according to a source-filter model that encodes the input speech signal as (A) a set of parameters that describe a filter and (B) an excitation signal that drives the described filter to produce a synthesized reproduction of the input speech signal. For example, a spectral envelope of a speech signal is characterized by a number of peaks that represent resonances of the vocal tract and are called formants. Most speech coders encode at least this coarse spectral structure as a set of parameters such as filter coefficients.

In one example of a basic source-filter arrangement, an analysis module calculates a set of parameters that characterize a filter corresponding to the speech sound over a period of time (typically 20 msec). A whitening filter (also called an analysis or prediction error filter) configured according to those filter parameters removes the spectral envelope to spectrally flatten the signal. The resulting whitened signal (also called a residual) has less energy and thus less variance and is easier to encode than the original speech signal. Errors resulting from coding of the residual signal may also be spread more evenly over the spectrum. The filter parameters and residual are typically quantized for efficient transmission over the channel. At the decoder, a synthesis filter configured according to the filter parameters is excited by the residual to produce a synthesized version of the original speech sound. The synthesis filter is typically configured to have a transfer function that is the inverse of the transfer function of the whitening filter.

The analysis module may be implemented as a linear prediction coding (LPC) analysis module that encodes the spectral envelope of the speech signal as a set of linear prediction (LP) coefficients (e.g., coefficients of an all-pole filter 1/A(z)). The analysis module typically processes the input signal as a series of nonoverlapping frames, with a new set of coefficients being calculated for each frame. The frame period is generally a period over which the signal may be expected to be locally stationary; one common example is 20 milliseconds (equivalent to 160 samples at a sampling rate of 8 kHz). One example of a lowband LPC analysis module is configured to calculate a set of ten LP filter coefficients to characterize the formant structure of each 20-millisecond frame of lowband speech signal S20, and one example of a highband LPC analysis module is configured to calculate a set of six (alternatively, eight) LP filter coefficients to characterize the formant structure of each 20-millisecond frame of highband speech signal S30. It is also possible to implement the analysis module to process the input signal as a series of overlapping frames.

The analysis module may be configured to analyze the samples of each frame directly, or the samples may be weighted first according to a windowing function (for example, a Hamming window). The analysis may also be performed over a window that is larger than the frame, such as a 30-msec window. This window may be symmetric (e.g. 5-20-5, such that it includes the 5 milliseconds immediately before and after the 20-millisecond frame) or asymmetric (e.g. 10-20, such that it includes the last 10 milliseconds of the preceding frame). An LPC analysis module is typically configured to calculate the LP filter coefficients using a Levinson-Durbin recursion or the Leroux-Gueguen algorithm. In another implementation, the analysis module may be configured to calculate a set of cepstral coefficients for each frame instead of a set of LP filter coefficients.

The output rate of a speech encoder may be reduced significantly, with relatively little effect on reproduction quality, by quantizing the filter parameters. Linear prediction filter coefficients are difficult to quantize efficiently and are usually mapped by the speech encoder into another representation, such as line spectral pairs (LSPs) or line spectral frequencies (LSFs), for quantization and/or entropy encoding. Other one-to-one representations of LP filter coefficients include parcor coefficients; log-area-ratio values; immittance spectral pairs (ISPs); and immittance spectral frequencies (ISFs), which are used in the GSM (Global System for Mobile Communications) AMR-WB (Adaptive Multirate-Wideband) codec. Typically a transform between a set of LP filter coefficients and a corresponding set of LSFs is reversible, but embodiments also include implementations of a speech encoder in which the transform is not reversible without error.

A speech encoder is typically configured to quantize the set of narrowband LSFs (or other coefficient representation) and to output the result of this quantization as the filter parameters. Quantization is typically performed using a vector quantizer that encodes the input vector as an index to a corresponding vector entry in a table or codebook. Such a quantizer may also be configured to perform classified vector quantization. For example, such a quantizer may be configured to select one of a set of codebooks based on information that has already been coded within the same frame (e.g., in the lowband channel and/or in the highband channel). Such a technique typically provides increased coding efficiency at the expense of additional codebook storage.

A speech encoder may also be configured to generate a residual signal by passing the speech signal through a whitening filter (also called an analysis or prediction error filter) that is configured according to the set of filter coefficients. The whitening filter is typically implemented as a FIR filter, although IIR implementations may also be used. This residual signal will typically contain perceptually important information of the speech frame, such as long-term structure relating to pitch, that is not represented in the filter parameters. Again, this residual signal is typically quantized for output. For example, lowband speech encoder A122 may be configured to calculate a quantized representation of the residual signal for output as encoded lowband excitation signal S50. Such quantization is typically performed using a vector quantizer that encodes the input vector as an index to a corresponding vector entry in a table or codebook and that may be configured to perform classified vector quantization as described above.

Alternatively, such a quantizer may be configured to send one or more parameters from which the vector may be generated dynamically at the decoder, rather than retrieved from storage, as in a sparse codebook method. Such a method is used in coding schemes such as algebraic CELP (codebook excitation linear prediction) and codecs such as 3GPP2 (Third Generation Partnership 2) EVRC (Enhanced Variable Rate Codec).

Some implementations of lowband speech encoder A120 are configured to calculate encoded lowband excitation signal S50 by identifying one among a set of codebook vectors that best matches the residual signal. It is noted, however, that lowband speech encoder A120 may also be implemented to calculate a quantized representation of the residual signal without actually generating the residual signal. For example, lowband speech encoder A120 may be configured to use a number of codebook vectors to generate corresponding synthesized signals (e.g., according to a current set of filter parameters), and to select the codebook vector associated with the generated signal that best matches the original lowband speech signal S20 in a perceptually weighted domain.

It may be desirable to implement lowband speech encoder A120 or A122 as an analysis-by-synthesis speech encoder. Codebook excitation linear prediction (CELP) coding is one popular family of analysis-by-synthesis coding, and implementations of such coders may perform waveform encoding of the residual, including such operations as selection of entries from fixed and adaptive codebooks, error minimization operations, and/or perceptual weighting operations. Other implementations of analysis-by-synthesis coding include mixed excitation linear prediction (MELP), algebraic CELP (ACELP), relaxation CELP (RCELP), regular pulse excitation (RPE), multi-pulse CELP (MPE), and vector-sum excited linear prediction (VSELP) coding. Related coding methods include multi-band excitation (MBE) and prototype waveform interpolation (PWI) coding. Examples of standardized analysis-by-synthesis speech codecs include the ETSI (European Telecommunications Standards Institute)-GSM full rate codec (GSM 06.10), which uses residual excited linear prediction (RELP); the GSM enhanced full rate codec (ETSI-GSM 06.60); the ITU (International Telecommunication Union) standard 11.8 kb/s G.729 Annex E coder; the IS (Interim Standard)-641 codecs for IS-136 (a time-division multiple access scheme); the GSM adaptive multirate (GSM-AMR) codecs; and the 4GV™ (Fourth-Generation Vocoder™) codec (QUALCOMM Incorporated, San Diego, Calif.). Existing implementations of RCELP coders include the Enhanced Variable Rate Codec (EVRC), as described in Telecommunications Industry Association (TIA) IS-127, and the Third Generation Partnership Project 2 (3GPP2) Selectable Mode Vocoder (SMV). The various lowband, highband, and wideband encoders described herein may be implemented according to any of these technologies, or any other speech coding technology (whether known or to be developed) that represents a speech signal as (A) a set of parameters that describe a filter and (B) a residual signal that provides at least part of an excitation used to drive the described filter to reproduce the speech signal.

Figure 12:
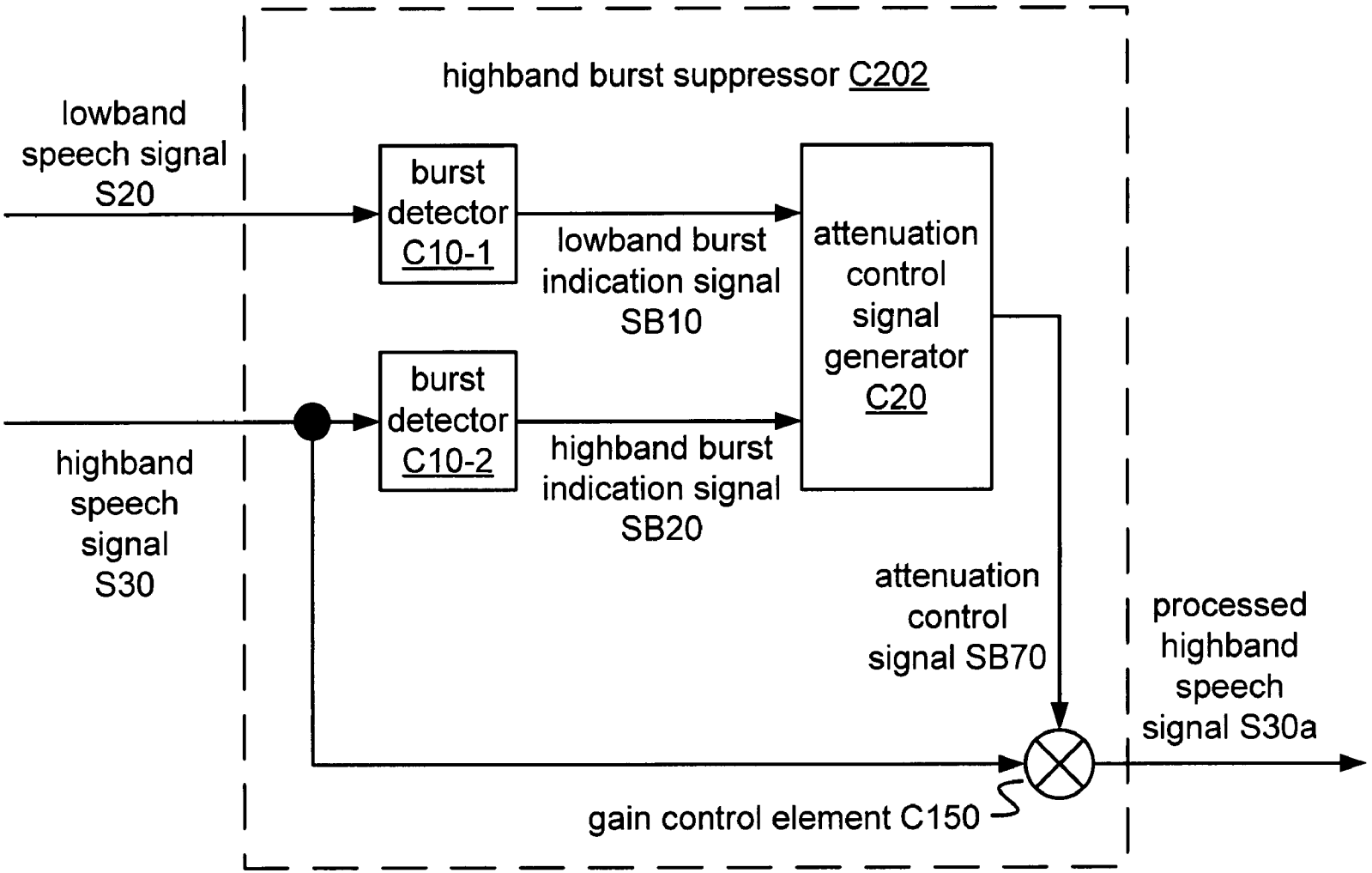
FIG. 12 shows a block diagram of an implementation C202 of highband burst suppressor C200.

FIG. 12 shows a block diagram of an implementation C202 of highband burst suppressor C200 that includes two implementations C10-1, C10-2 of burst detector C10. Burst detector C10-1 is configured to produce a lowband burst indication signal SB10 that indicates a presence of a burst in lowband speech signal S20. Burst detector C10-2 is configured to produce a highband burst indication signal SB20 that indicates a presence of a burst in highband speech signal S30. Burst detectors C10-1 and C10-2 may be identical or may be instances of different implementations of burst detector C10. Highband burst suppressor C202 also includes an attenuation control signal generator C20 configured to generate an attenuation control signal SB70 according to a relation between lowband burst indication signal SB10 and highband burst indication signal SB20, and a gain control element C150 (e.g., a multiplier or amplifier) configured to apply attenuation control signal SB70 to highband speech signal S30 to produce processed highband speech signal S30*a*.

In the particular examples described herein, it may be assumed that highband burst suppressor C202 processes highband speech signal S30 in 20-millisecond frames, and that lowband speech signal S20 and highband speech signal S30 are both sampled at 8 kHz. However, these particular values are examples only, and not limitations, and other values may also be used according to particular design choices and/or as noted herein.

Burst detector C10 is configured to calculate forward and backward smoothed envelopes of the speech signal and to indicate the presence of a burst according to a time relation between an edge in the forward smoothed envelope and an edge in the backward smoothed envelope. Burst suppressor C202 includes two instances of burst detector C10, each arranged to receive a respective one of speech signals S20, S30 and to output a corresponding burst indication signal SB10, SB20.

Figure 13:
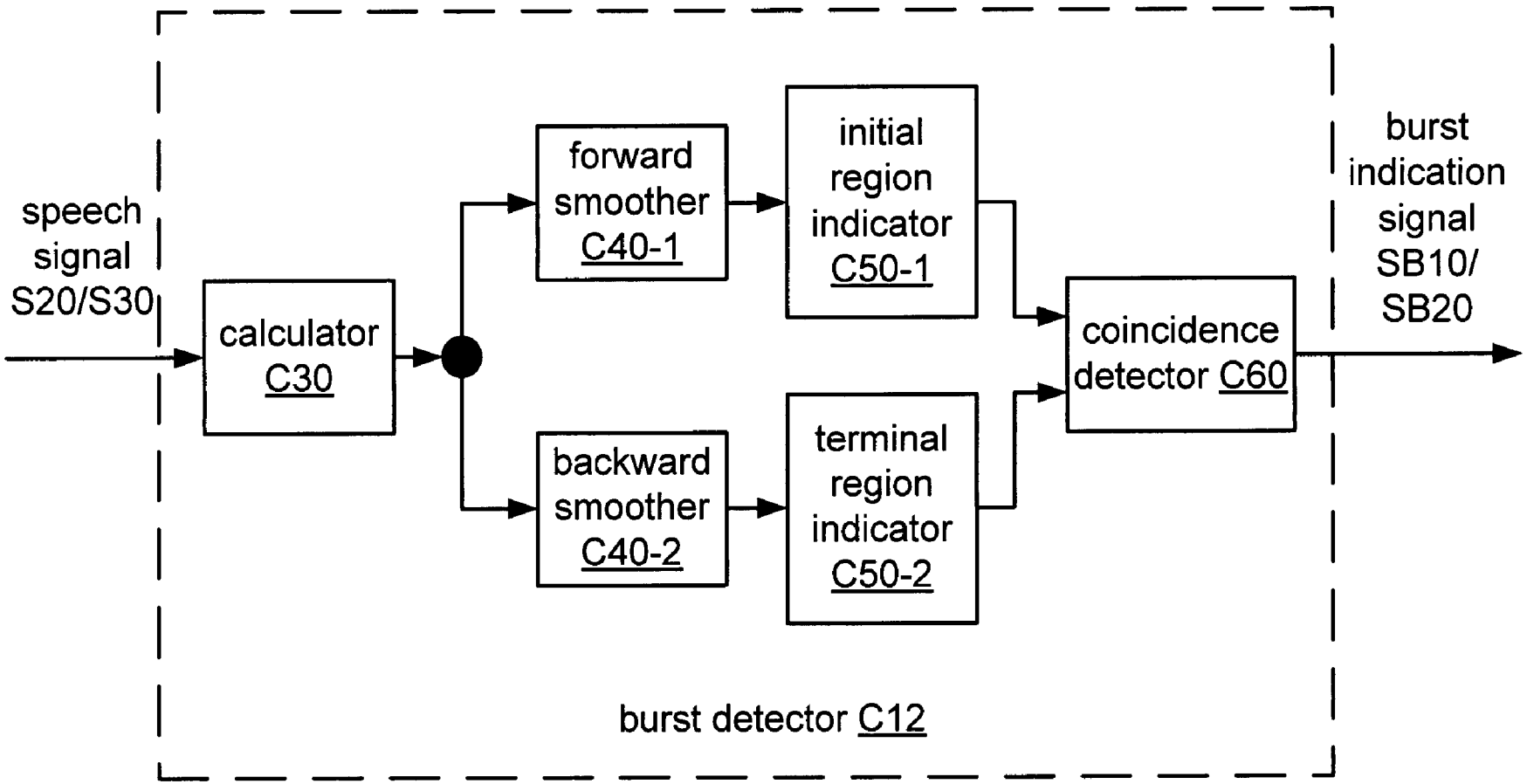
FIG. 13 shows a block diagram of an implementation C12 of burst detector C10.

FIG. 13 shows a block diagram of an implementation C12 of burst detector C10 that is arranged to receive one of speech signals S20, S30 and to output a corresponding burst indication signal SB10, SB20. Burst detector C12 is configured to calculate each of the forward and backward smoothed envelopes in two stages. In the first stage, a calculator C30 is configured to convert the speech signal to a constant-polarity signal. In one example, calculator C30 is configured to compute the constant-polarity signal as the square of each sample of the current frame of the corresponding speech signal. Such a signal may be smoothed to obtain an energy envelope. In another example, calculator C30 is configured to compute the absolute value of each incoming sample. Such a signal may be smoothed to obtain an amplitude envelope. Further implementations of calculator C30 may be configured to compute the constant-polarity signal according to another function such as clipping.

In the second stage, a forward smoother C40-1 is configured to smooth the constant-polarity signal in a forward time direction to produce a forward smoothed envelope, and a backward smoother C40-2 is configured to smooth the constant-polarity signal in a backward time direction to produce a backward smoothed envelope. The forward smoothed envelope indicates a difference in the level of the corresponding speech signal over time in the forward direction, and the backward smoothed envelope indicates a difference in the level of the corresponding speech signal over time in the backward direction.

In one example, forward smoother C40-1 is implemented as a first-order infinite-impulse-response (IIR) filter configured to smooth the constant-polarity signal according to an expression such as the following:

$$S_f(n)=\alpha S_f(n-1)+(1-\alpha)P(n),$$

and backward smoother C40-2 is implemented as a first-order IIR filter configured to smooth the constant-polarity signal according to an expression such as the following:

$$S_b(n)=\alpha S_b(n+1)+(1-\alpha)P(n),$$

where n is a time index, P (n) is the constant-polarity signal, $S_f(n)$ is the forward smoothed envelope, $S_b(n)$ is the backward smoothed envelope, and $\alpha$ is a decay factor having a value between 0 (no smoothing) and 1. It may be noted that due in part to operations such as calculation of a backward smoothed envelope, a delay of at least one frame may be incurred in processed highband speech signal S30*a*. However, such a delay is relatively unimportant perceptually and is not uncommon even in real-time speech processing operations.

It may be desirable to select a value for $\alpha$ such that the decay time of the smoother is similar to the expected duration of a highband burst (e.g., about 5 milliseconds). Typically forward smoother C40-1 and backward smoother C40-2 are configured to perform complementary versions of the same smoothing operation, and to use the same value of $\alpha$, but in some implementations the two smoothers may be configured to perform different operations and/or to use different values. Other recursive or non-recursive smoothing functions, including finite-impulse-response (FIR) or IIR filters of higher order, may also be used.

In other implementations of burst detector C12, one or both of forward smoother C40-1 and backward smoother C40-2 are configured to perform an adaptive smoothing operation. For example, forward smoother C40-1 may be configured to perform an adaptive smoothing operation according to an expression such as the following:

$$S_f(n)=\begin{cases} P(n), & \text{if } P(n)\geq S_f(n-1) \\ \alpha S_f(n-1)+(1-\alpha)P(n), & \text{if } P(n)<S_f(n-1), \end{cases}$$

in which smoothing is reduced or, as in this case, disabled at strong leading edges of the constant-polarity signal. In this or another implementation of burst detector C12, backward smoother C40-2 may be configured to perform an adaptive smoothing operation according to an expression such as the following:

$$S_b(n)=\begin{cases} P(n), & \text{if } P(n)\geq S_b(n+1) \\ \alpha S_b(n+1)+(1-\alpha)P(n), & \text{if } P(n)<S_b(n+1), \end{cases}$$

in which smoothing is reduced or, as in this case, disabled at strong trailing edges of the constant-polarity signal. Such adaptive smoothing may help to define the beginnings of burst events in the forward smoothed envelope and the ends of burst events in the backward smoothed envelope.

Burst detector C12 includes an instance of a region indicator C50 (initial region indicator C50-1) that is configured to indicate the beginning of a high-level event (e.g., a burst) in the forward smoothed envelope. Burst detector C12 also includes an instance of region indicator C50 (terminal region indicator C50-2) that is configured to indicate the ending of a high-level event (e.g., a burst) in the backward smoothed envelope.

Figure 14A:
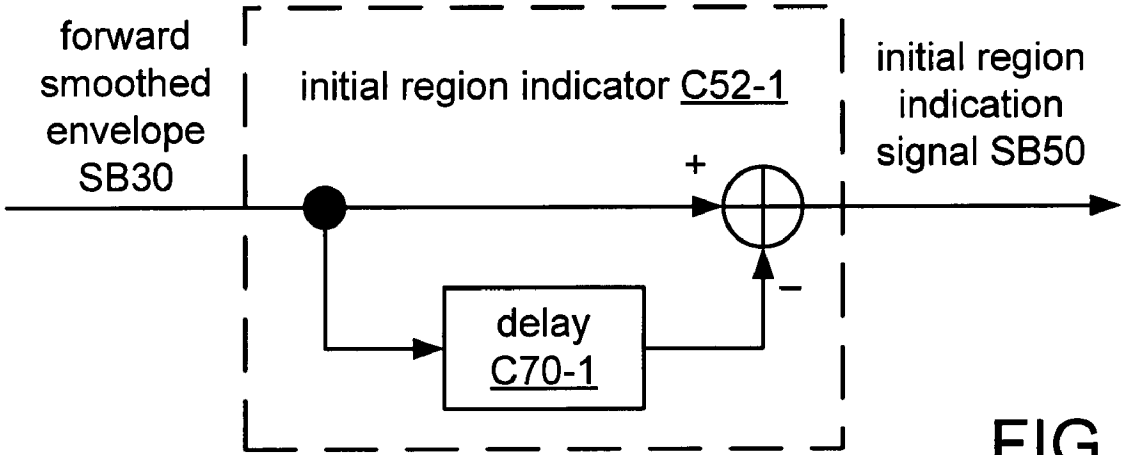
FIGS. 14*a* and 14*b* show block diagrams of implementations C52-1, C52-2 of initial region indicator C50-1 and terminal region indicator C50-2, respectively.

FIG. 14*a* shows a block diagram of an implementation C52-1 of initial region indicator C50-1 that includes a delay element C70-1 and an adder. Delay C70-1 is configured to apply a delay having a positive magnitude, such that the forward smoothed envelope is reduced by a delayed version of itself. In another example, the current sample or the delayed sample may be weighted according to a desired weighting factor.

Figure 14B:
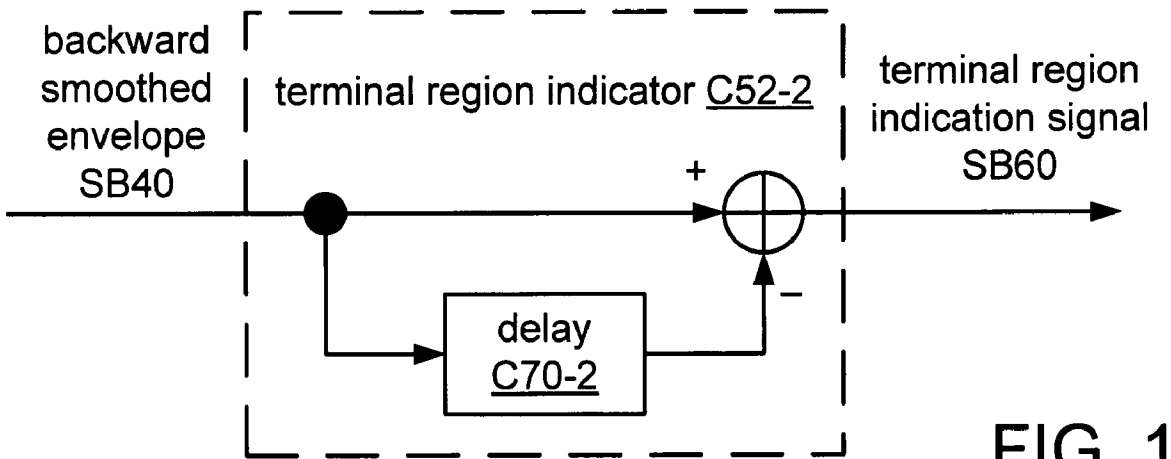

FIG. 14*b* shows a block diagram of an implementation C52-2 of terminal region indicator C50-2 that includes a delay element C70-2 and an adder. Delay C70-2 is configured to apply a delay having a negative magnitude, such that the backward smoothed envelope is reduced by an advanced version of itself. In another example, the current sample or the advanced sample may be weighted according to a desired weighting factor.

Various delay values may be used in different implementations of region indicator C52, and delay values having different magnitudes may be used in initial region indicator C52-1 and terminal region indicator C52-2. The magnitude of the delay may be selected according to a desired width of the detected region. For example, small delay values may be used to perform detection of a narrow edge region. To obtain strong edge detection, it may be desired to use a delay having a magnitude similar to the expected edge width (for example, about 3 or 5 samples).

Alternatively, a region indicator C50 may be configured to indicate a wider region that extends beyond the corresponding edge. For example, it may be desirable for initial region indicator C50-1 to indicate an initial region of an event that extends in the forward direction for some time after the leading edge. Likewise, it may be desirable for terminal region indicator C50-2 to indicate a terminal region of an event that extends in the backward direction for some time before the trailing edge. In such case, it may be desirable to use a delay value having a larger magnitude, such as a magnitude similar to that of the expected length of a burst. In one such example, a delay of about 4 milliseconds is used.

Processing by a region indicator C50 may extend beyond the boundaries of the current frame of the speech signal, according to the magnitude and direction of the delay. For example, processing by initial region indicator C50-1 may extend into the preceding frame, and processing by terminal region indicator C50-2 may extend into the following frame.

As compared to other high-level events that may occur in the speech signal, a burst is distinguished by an initial region, as indicated in initial region indication signal SB50, that coincides in time with a terminal region, as indicated in terminal region indication signal SB60. For example, a burst may be indicated when the time distance between the initial and terminal regions is not greater than (alternatively, is less than) a predetermined coincidence interval, such as the expected duration of a burst. Coincidence detector C60 is configured to indicate detection of a burst according to a coincidence in time of initial and terminal regions in the region indication signals SB50 and SB60. For an implementation in which initial and terminal region indication signals SB50, SB60 indicate regions that extend from the respective leading and trailing edges, for example, coincidence detector C60 may be configured to indicate an overlap in time of the extended regions.

Figure 15:
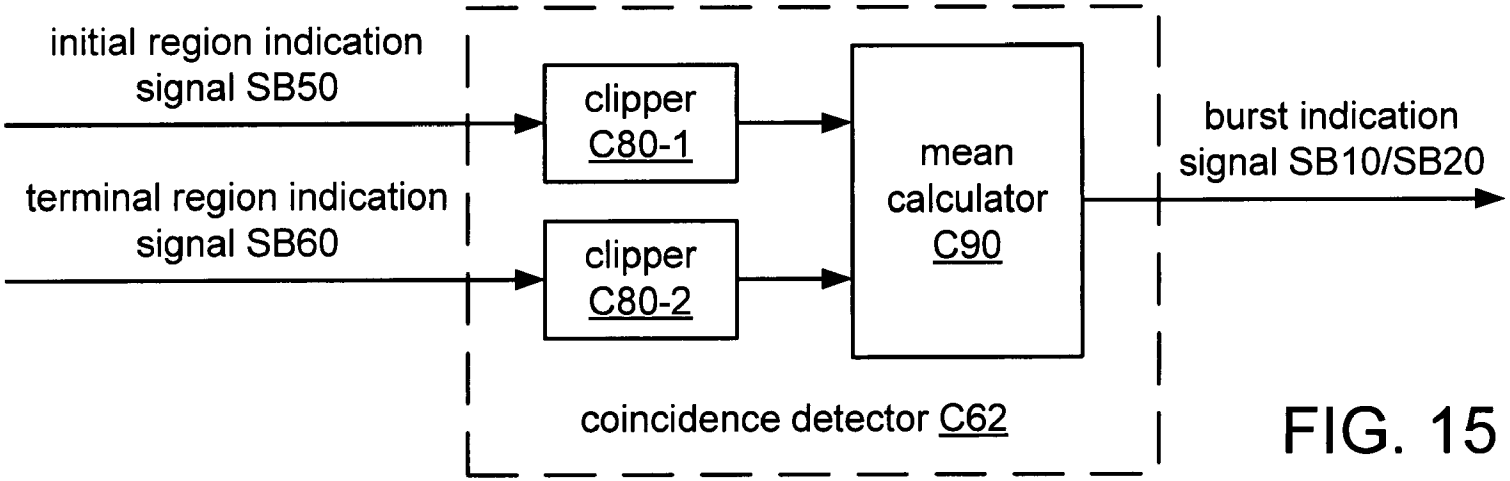
FIG. 15 shows a block diagram of an implementation C62 of coincidence detector C60.

FIG. 15 shows a block diagram of an implementation C62 of coincidence detector C60 that includes a first instance C80-1 of clipper C80 configured to clip initial region indication signal SB50, a second instance C80-2 of clipper C80 configured to clip terminal region indication signal SB60, and a mean calculator C90 configured to output a corresponding burst indication signal according to a mean of the clipped signals. Clipper C80 is configured to clip values of the input signal according to an expression such as the following:

$$\text{out}=\max(\text{in},0).$$

Alternatively, clipper C80 may be configured to threshold the input signal according to an expression such as the following:

$$\text{out}=\begin{cases}\text{in}, & \text{in}\geq T_L\\ 0, & \text{in}<T_L,\end{cases}$$

where threshold $T_L$ has a value greater than zero. Typically the instances C80-1 and C80-2 of clipper C80 will use the same threshold value, but it is also possible for the two instances C80-1 and C80-2 to use different threshold values.

Mean calculator C90 is configured to output a corresponding burst indication signal SB10, SB20, according to a mean of the clipped signals, that indicates the time location and strength of bursts in the input signal and has a value equal to or larger than zero. The geometric mean may provide better results than the arithmetic mean, especially for distinguishing bursts with defined initial and terminal regions from other events that have only a strong initial or terminal region. For example, the arithmetic mean of an event with only one strong edge may still be high, whereas the geometric mean of an event lacking one of the edges will be low or zero. However, the geometric mean is typically more computationally intensive than the arithmetic mean. In one example, an instance of mean calculator C90 arranged to process lowband results uses the arithmetic mean (½(a+b)), and an instance of mean calculator C90 arranged to process highband results uses the more conservative geometric mean ($\sqrt{a\cdot b}$).

Other implementations of mean calculator C90 may be configured to use a different kind of mean, such as the harmonic mean. In a further implementation of coincidence detector C62, one or both of the initial and terminal region indication signals SB50, SB60 is weighted with respect to the other before or after clipping.

Other implementations of coincidence detector C60 are configured to detect bursts by measuring a time distance between leading and trailing edges. For example, one such implementation is configured to identify a burst as the region between a leading edge in initial region indication signal SB50 and a trailing edge in terminal region indication signal SB60 that are no more than a predetermined width apart. The predetermined width is based on an expected duration of a highband burst, and in one example a width of about 4 milliseconds is used.

A further implementation of coincidence detector C60 is configured to expand each leading edge in initial region indication signal SB50 in the forward direction by a desired time period (e.g. based on an expected duration of a highband burst), and to expand each trailing edge in terminal region indication signal SB60 in the backward direction by a desired time period (e.g. based on an expected duration of a highband burst). Such an implementation may be configured to generate the corresponding burst indication signal SB10, SB20 as the logical AND of these two expanded signals or, alternatively, to generate the corresponding burst indication signal SB10, SB20 to indicate a relative strength of the burst across an area where the regions overlap (e.g. by calculating a mean of the expanded signals). Such an implementation may be configured to expand only edges that exceed a threshold value. In one example, the edges are expanded by a time period of about 4 milliseconds.

Attenuation control signal generator C20 is configured to generate attenuation control signal SB70 according to a relation between lowband burst indication signal SB10 and highband burst indication signal SB20. For example, attenuation control signal generator C20 may be configured to generate attenuation control signal SB70 according to an arithmetic relation between burst indication signals SB10 and SB20, such as a difference.

Figure 16:
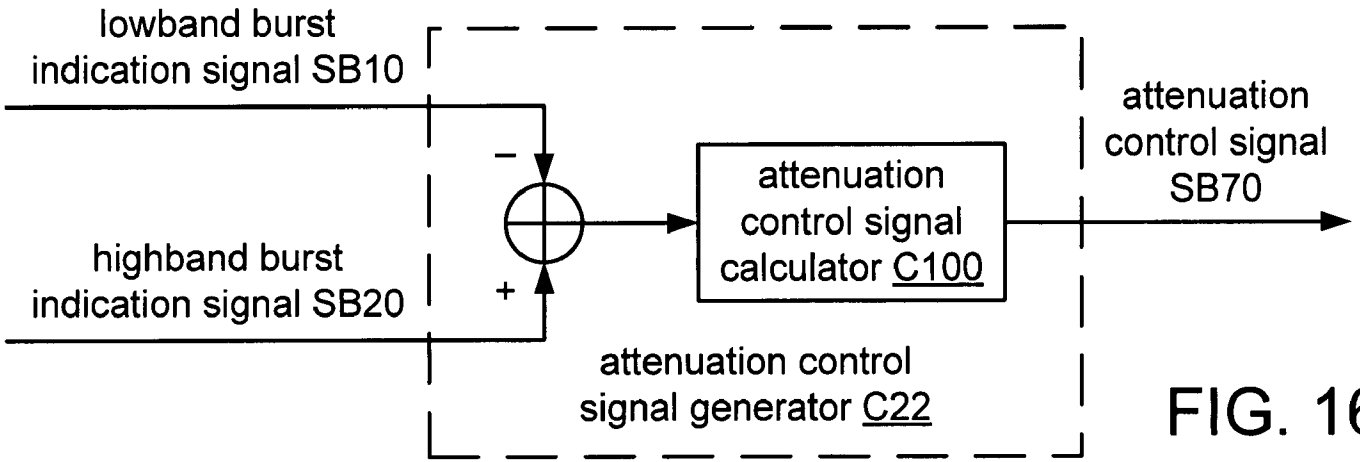
FIG. 16 shows a block diagram of an implementation C22 of attenuation control signal generator C20.

FIG. 16 shows a block diagram of an implementation C22 of attenuation control signal generator C20 that is configured to combine lowband burst indication signal SB10 and highband burst indication signal SB20 by subtracting the former from the latter. The resulting difference signal indicates where bursts exist in the high band that do not occur (or are weaker) in the low band. In a further implementation, one or both of the lowband and highband burst indication signals SB10, SB20 is weighted with respect to the other.

Attenuation control signal calculator C100 outputs attenuation control signal SB70 according to a value of the difference signal. For example, attenuation control signal calculator C100 may be configured to indicate an attenuation that varies according to the degree to which the difference signal exceeds a threshold value.

Figure 17:
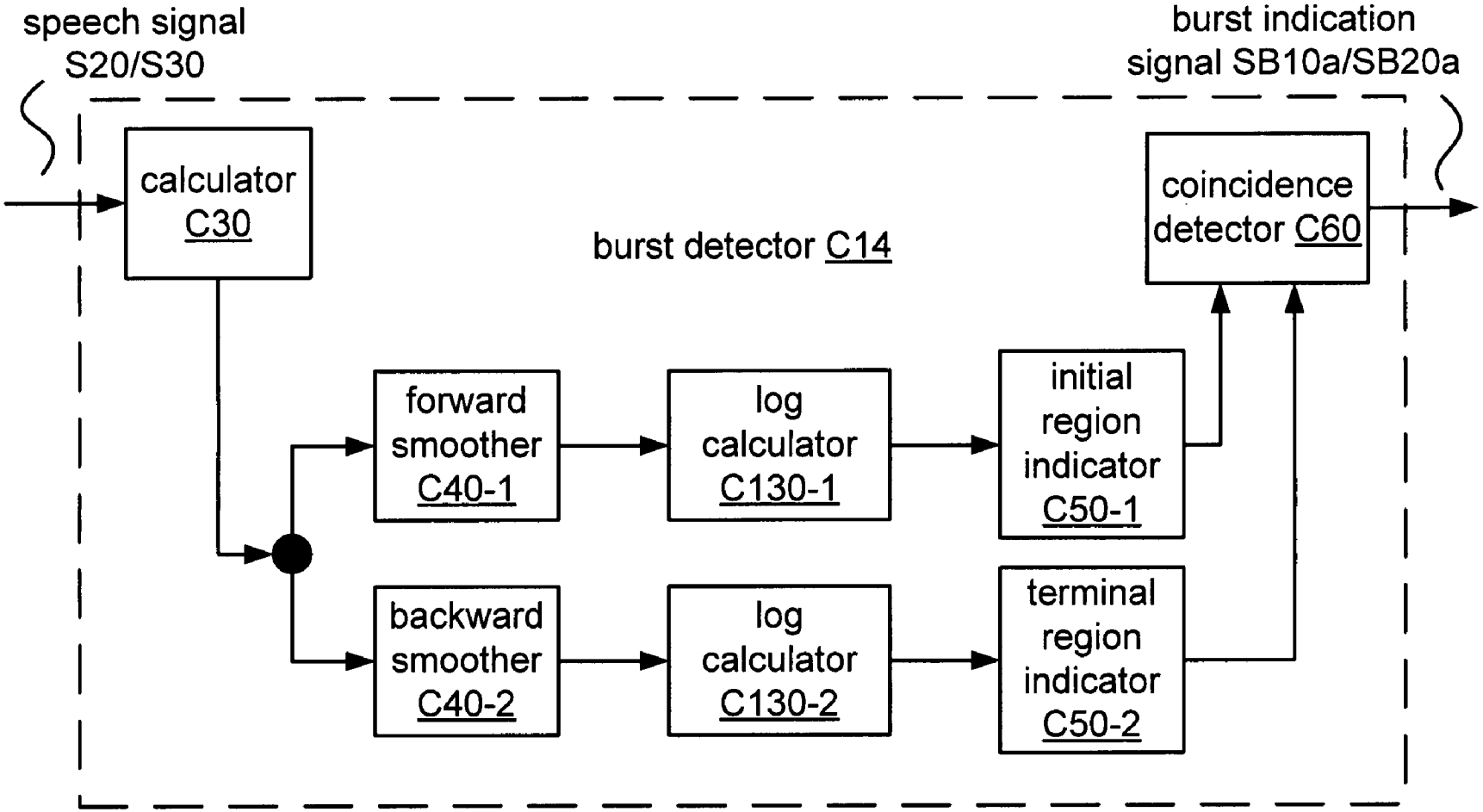
FIG. 17 shows a block diagram of an implementation C14 of burst detector C12.

It may be desired for attenuation control signal generator C20 to be configured to perform operations on logarithmically scaled values. For example, it may be desirable to attenuate highband speech signal S30 according to a ratio between the levels of the burst indication signals (for example, according to a value in decibels or dB), and such a ratio may be easily calculated as the difference of logarithmically scaled values. The logarithmic scaling warps the signal along the magnitude axis but does not otherwise change its shape. FIG. 17 shows an implementation C14 of burst detector C12 that includes an instance C130-1, C130-2 of logarithm calculator C130 configured to logarithmically scale (e.g., according to a base of 10) the smoothed envelope in each of the forward and backward processing paths.

In one example, attenuation control signal calculator C100 is configured to calculate values of attenuation control signal SB70 in dB according to the following formula:

$$A_{dB}=\begin{cases}0, & \text{if } D_{dB}<T_{dB}\\ 20\left(1-\dfrac{2}{1+\exp(D_{dB}/10)}\right), & \text{if } D_{dB}>T_{dB},\end{cases}$$

where $D_{dB}$ denotes the difference between highband burst indication signal SB20 and lowband burst indication signal SB10, $T_{dB}$ denotes a threshold value, and $A_{dB}$ is the corresponding value of attenuation control signal SB70. In one particular example, threshold $T_{dB}$ has a value of 8 dB.

In another implementation, attenuation control signal calculator C100 is configured to indicate a linear attenuation according to the degree to which the difference signal exceeds a threshold value (e.g., 3 dB or 4 dB). In this example, attenuation control signal SB70 indicates no attenuation until the difference signal exceeds the threshold value. When the difference signal exceeds the threshold value, attenuation control signal SB70 indicates an attenuation value that is linearly proportional to the amount by which the threshold value is currently exceeded.

Highband burst suppressor C202 includes a gain control element C150, such as a multiplier or amplifier, that is configured to attenuate highband speech signal S30 according to the current value of attenuation control signal SB70 to produce processed highband speech signal S30*a*. Typically, attenuation control signal SB70 indicates a value of no attenuation (e.g., a gain of 1.0 or 0 dB) unless a highband burst has been detected at the current location of highband speech signal S30, in which case a typical attenuation value is a gain reduction of 0.3 or about 10 dB.

An alternative implementation of attenuation control signal generator C22 may be configured to combine lowband burst indication signal SB10 and highband burst indication signal SB20 according to a logical relation. In one such example, the burst indication signals are combined by computing the logical AND of highband burst indication signal SB20 and the logical inverse of lowband burst indication signal SB10. In this case, each of the burst indication signals may first be thresholded to obtain a binary-valued signal, and attenuation control signal calculator C100 may be configured to indicate a corresponding one of two attenuation states (e.g., one state indicating no attenuation) according to the state of the combined signal.

Before performing the envelope calculation, it may be desirable to shape the spectrum of one or both of speech signals S20 and S30 in order to flatten the spectrum and/or to emphasize or attenuate one or more particular frequency regions. Lowband speech signal S20, for example, may tend to have more energy at low frequencies, and it may be desirable to reduce this energy. It may also be desirable to reduce high-frequency components of lowband speech signal S20 such that the burst detection is based primarily on the middle frequencies. Spectral shaping is an optional operation that may improve the performance of burst suppressor C200.

Figure 18:
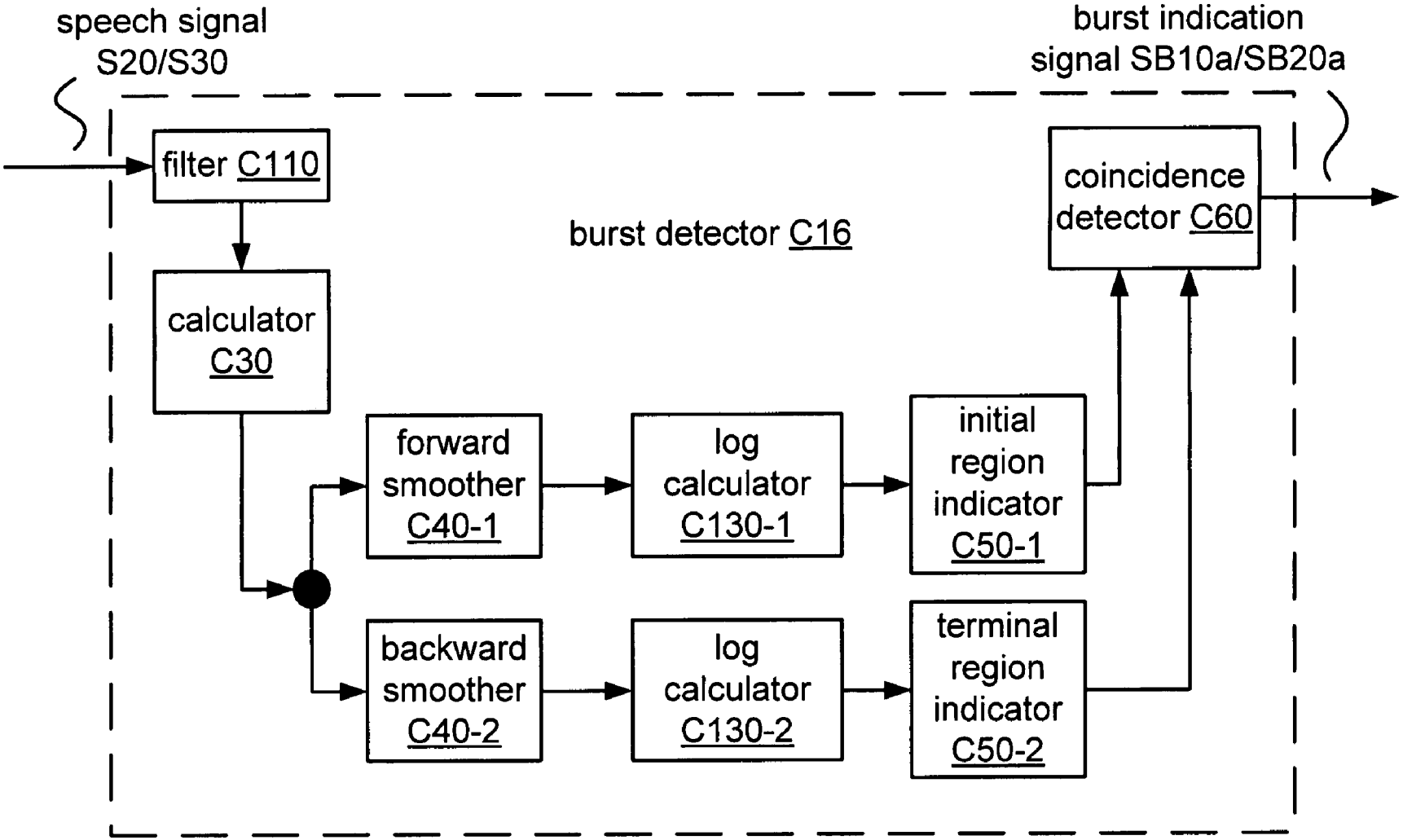
FIG. 18 shows a block diagram of an implementation C16 of burst detector C14.

FIG. 18 shows a block diagram of an implementation C16 of burst detector C14 that includes a shaping filter C110. In one example, filter C110 is configured to filter lowband speech signal S20 according to a passband transfer function such as the following:

$$F_{LB}(z) = \frac{1 + 0.96z^{-1} + 0.96z^{-2} + z^{-3}}{1 - 0.5z^{-1}},$$

which attenuates very low and high frequencies.

It may be desired to attenuate low frequencies of highband speech signal S30 and/or to boost higher frequencies. In one example, filter C110 is configured to filter highband speech signal S30 according to a highpass transfer function such as the following:

$$F_{HB}(z) = \frac{0.5 + z^{-1} + 0.5z^{-2}}{1 + 0.5z^{-1} + 0.3z^{-2}},$$

which attenuates frequencies around 4 kHz.

Figure 19:
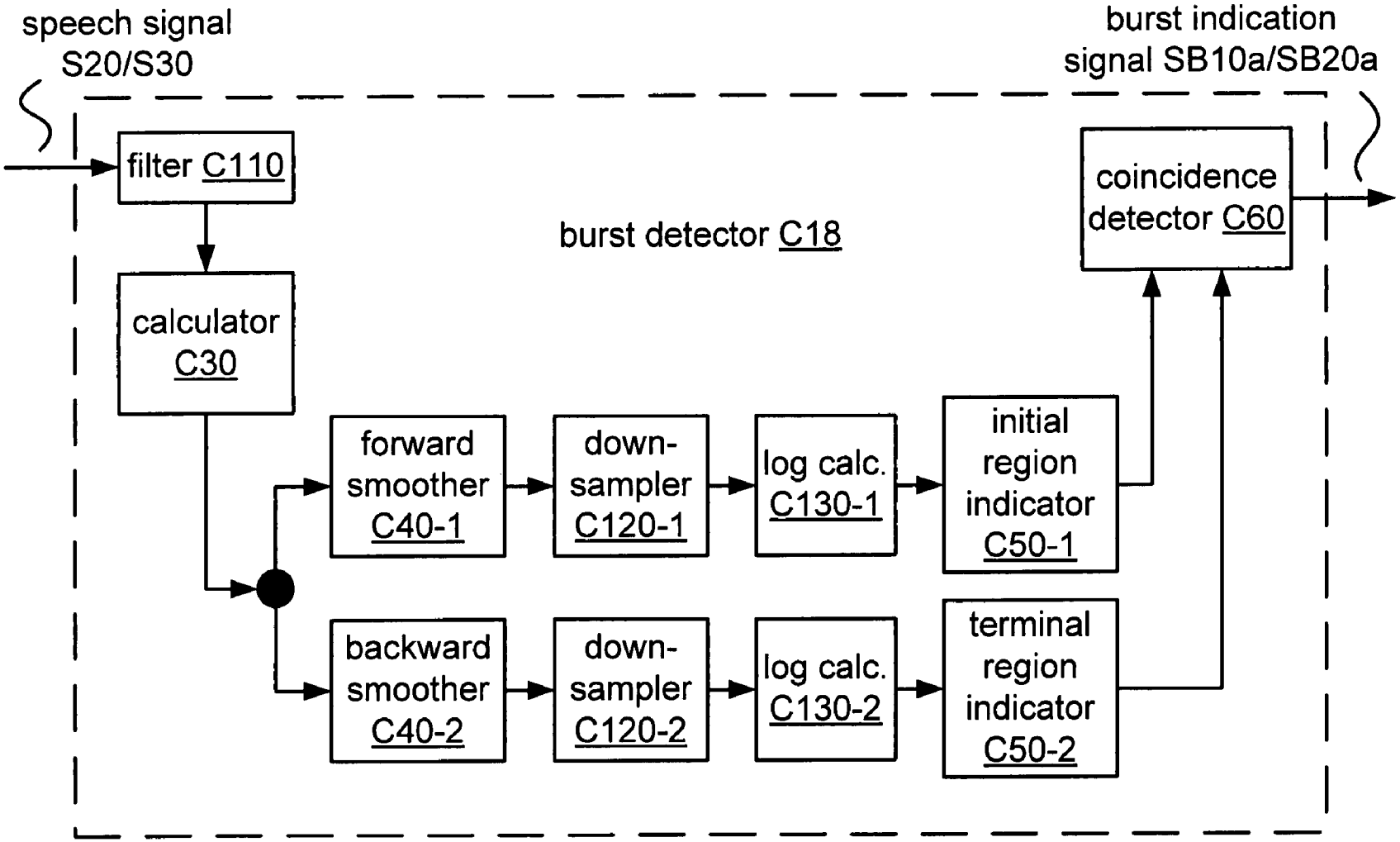
FIG. 19 shows a block diagram of an implementation C18 of burst detector C16.

It may be unnecessary in a practical sense to perform at least some of the burst detection operations at the full sampling rate of the corresponding speech signal S20, S30. FIG. 19 shows a block diagram of an implementation C18 of burst detector C16 that includes an instance C120-1 of a downsampler C120 that is configured to downsample the smoothed envelope in the forward processing path and an instance C120-2 of downsampler C120 that is configured to downsample the smoothed envelope in the backward processing path. In one example, each instance of downsampler C120 is configured to downsample the envelope by a factor of eight. For the particular example of a 20-millisecond frame sampled at 8 kHz (160 samples), such a downsampler reduces the envelope to a 1 kHz sampling rate, or 20 samples per frame. Downsampling may considerably reduce the computational complexity of a highband burst suppression operation without significantly affecting performance.

Figure 20:
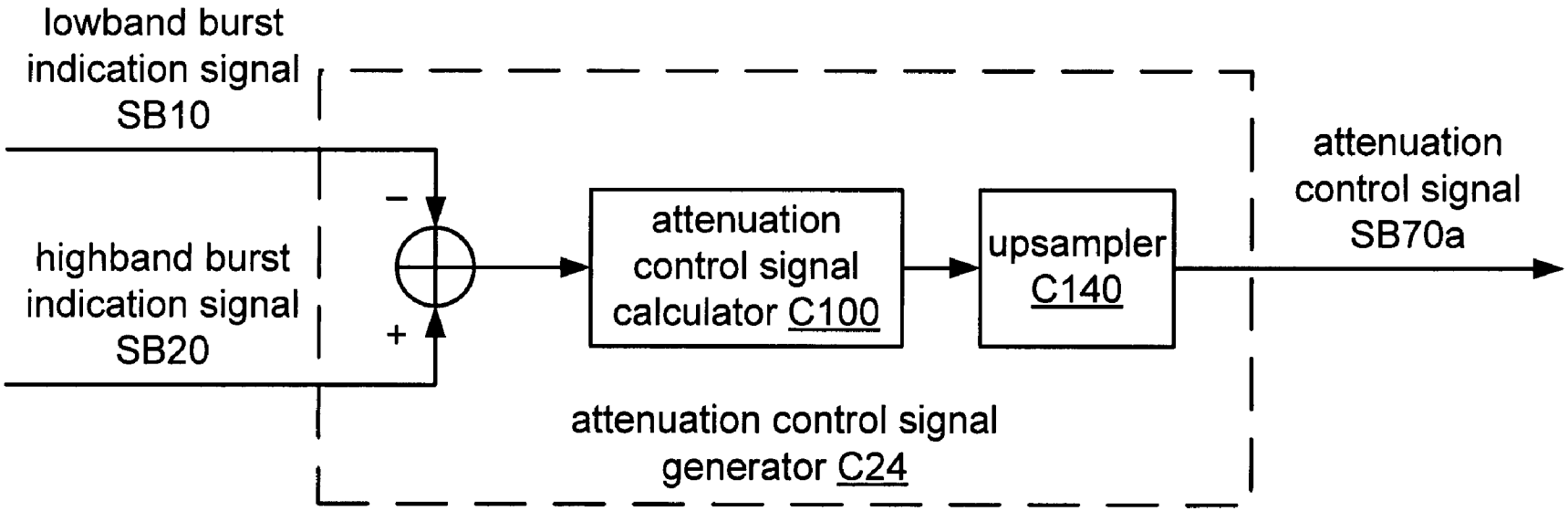
FIG. 20 shows a block diagram of an implementation C24 of attenuation control signal generator C22.

It may be desirable for the attenuation control signal applied by gain control element C150 to have the same sampling rate as highband speech signal S30. FIG. 20 shows a block diagram of an implementation C24 of attenuation control signal generator C22 that may be used in conjunction with a downsampling version of burst detector C10. Attenuation control signal generator C24 includes an upsampler C140 configured to upsample attenuation control signal SB70 to a signal SB70*a* having a sampling rate equal to that of highband speech signal S30.

In one example, upsampler C140 is configured to perform the upsampling by zeroth-order interpolation of attenuation control signal SB70. In another example, upsampler C140 is configured to perform the upsampling by otherwise interpolating between the values of attenuation control signal SB70 (e.g., by passing attenuation control signal SB70 through an FIR filter) to obtain less abrupt transitions. In a further example, upsampler C140 is configured to perform the upsampling using windowed sinc functions.

In some cases, such as in a battery-powered device (e.g., a cellular telephone), highband burst suppressor C200 may be configured to be selectively disabled. For example, it may be desired to disable an operation such as highband burst suppression in a power-saving mode of the device.

As mentioned above, embodiments as described herein include implementations that may be used to perform embedded coding, supporting compatibility with narrowband systems and avoiding a need for transcoding. Support for highband coding may also serve to differentiate on a cost basis between chips, chipsets, devices, and/or networks having wideband support with backward compatibility, and those having narrowband support only. Support for highband coding as described herein may also be used in conjunction with a technique for supporting lowband coding, and a system, method, or apparatus according to such an embodiment may support coding of frequency components from, for example, about 50 or 100 Hz up to about 7 or 8 kHz.

As mentioned above, adding highband support to a speech coder may improve intelligibility, especially regarding differentiation of fricatives. Although such differentiation may usually be derived by a human listener from the particular context, highband support may serve as an enabling feature in speech recognition and other machine interpretation applications, such as systems for automated voice menu navigation and/or automatic call processing. Highband burst suppression may increase accuracy in a machine interpretation application, and it is contemplated that an implementation of highband burst suppressor C200 may be used in one or more such applications without or without speech encoding.

An apparatus according to an embodiment may be embedded into a portable device for wireless communications such as a cellular telephone or personal digital assistant (PDA). Alternatively, such an apparatus may be included in another communications device such as a VoIP handset, a personal computer configured to support VoIP communications, or a network device configured to route telephonic or VoIP communications. For example, an apparatus according to an embodiment may be implemented in a chip or chipset for a communications device. Depending upon the particular application, such a device may also include such features as analog-to-digital and/or digital-to-analog conversion of a speech signal, circuitry for performing amplification and/or other signal processing operations on a speech signal, and/or radio-frequency circuitry for transmission and/or reception of the coded speech signal.

It is explicitly contemplated and disclosed that embodiments may include and/or be used with any one or more of the other features disclosed in the published patent applications US 2006/0271356, US 2006/0277038, US 2006/0277039, US 2006/0277042, US 2006/0282262, US 2006/0282263, US 2007/0088541, US 2007/0088542, and US 2007/0088558, and others cited herein. Such features include generation of a highband excitation signal from a lowband excitation signal, which may include other features such as anti-sparseness filtering, harmonic extension using a nonlinear function, mixing of a modulated noise signal with a spectrally extended signal, and/or adaptive whitening. Such features include time-warping a highband speech signal according to a regularization performed in a lowband encoder. Such features include encoding of a gain envelope according to a relation between an original speech signal and a synthesized speech signal. Such features include use of overlapping filter banks to obtain lowband and highband speech signals from a wideband speech signal. Such features include shifting of highband signal S30 and/or a highband excitation signal according to a regularization or other shift of lowband excitation signal S50 or narrowband residual signal S50. Such features include fixed or adaptive smoothing of coefficient representations such as highband LSFs. Such features include fixed or adaptive shaping of noise associated with quantization of coefficient representations such as LSFs. Such features also include fixed or adaptive smoothing of a gain envelope, and adaptive attenuation of a gain envelope.

The foregoing presentation of the described embodiments is provided to enable any person skilled in the art to make or use the present invention. Various modifications to these embodiments are possible, and the generic principles presented herein may be applied to other embodiments as well. For example, an embodiment may be implemented in part or in whole as a hard-wired circuit, as a circuit configuration fabricated into an application-specific integrated circuit, or as a firmware program loaded into non-volatile storage or a software program loaded from or into a data storage medium (e.g., a non-transitory computer-readable medium) as machine-readable code, such code being instructions executable by an array of logic elements such as a microprocessor or other digital signal processing unit. The non-transitory computer-readable medium may be an array of storage elements such as semiconductor memory (which may include without limitation dynamic or static RAM (random-access memory), ROM (read-only memory), and/or flash RAM), or ferroelectric, magnetoresistive, ovonic, polymeric, or phase-change memory; or a disk medium such as a magnetic or optical disk. The term "software" should be understood to include source code, assembly language code, machine code, binary code, firmware, macrocode, microcode, any one or more sets or sequences of instructions executable by an array of logic elements, and any combination of such examples.

The various elements of implementations of highband speech encoder A200; wideband speech encoder A100, A102, and A104; and highband burst suppressor C200; and arrangements including one or more such apparatus, may be implemented as electronic and/or optical devices residing, for example, on the same chip or among two or more chips in a chipset, although other arrangements without such limitation are also contemplated. One or more elements of such an apparatus may be implemented in whole or in part as one or more sets of instructions arranged to execute on one or more fixed or programmable arrays of logic elements (e.g., transistors, gates) such as microprocessors, embedded processors, IP cores, digital signal processors, FPGAs (field-programmable gate arrays), ASSPs (application-specific standard products), and ASICs (application-specific integrated circuits). It is also possible for one or more such elements to have structure in common (e.g., a processor used to execute portions of code corresponding to different elements at different times, a set of instructions executed to perform tasks corresponding to different elements at different times, or an arrangement of electronic and/or optical devices performing operations for different elements at different times). Moreover, it is possible for one or more such elements to be used to perform tasks or execute other sets of instructions that are not directly related to an operation of the apparatus, such as a task relating to another operation of a device or system in which the apparatus is embedded.

Embodiments also include additional methods of speech processing, speech encoding, and highband burst suppression as are expressly disclosed herein, e.g., by descriptions of structural embodiments configured to perform such methods. Each of these methods may also be tangibly embodied (for example, in one or more data storage media as listed above) as one or more sets of instructions readable and/or executable by a machine including an array of logic elements (e.g., a processor, microprocessor, microcontroller, or other finite state machine). Thus, the present invention is not intended to be limited to the embodiments shown above but rather is to be accorded the widest scope consistent with the principles and novel features disclosed in any fashion herein.

What is claimed is:

1. A method of signal processing, said method comprising performing each of the following acts within a device that is configured to process audio signals:

calculating a first burst indication signal that indicates whether a burst is detected in a low-frequency portion of a speech signal;

calculating a second burst indication signal that indicates whether a burst is detected in a high-frequency portion of the speech signal;

generating an attenuation control signal according to a relation between the first and second burst indication signals; and applying the attenuation control signal to the high-frequency portion of the speech signal to produce a processed high-frequency signal portion, wherein calculating at least one of the first and second burst indication signals comprises:

producing a forward smoothed envelope of a corresponding portion of the speech signal, the forward smoothed envelope being smoothed in a positive time direction;

indicating an initial region of a burst in the forward smoothed envelope;

producing a backward smoothed envelope of the corresponding portion of the speech signal, the backward smoothed envelope being smoothed in a negative time direction; and indicating a terminal region of a burst in the backward smoothed envelope.

2. The method of signal processing according to claim 1, wherein the speech signal is an audio-frequency speech signal.

3. The method of signal processing according to claim 1, wherein at least one of said calculating a first burst indication signal and calculating a second burst indication signal comprises detecting a coincidence in time of the initial and terminal regions.

4. The method of signal processing according to claim 1, wherein at least one of said calculating a first burst indication signal and calculating a second burst indication signal comprises indicating a burst according to an overlap in time of the initial and terminal regions.

5. The method according to claim 1, wherein at least one of said calculating a first burst indication signal and calculating a second burst indication signal comprises calculating the corresponding burst indication signal according to a mean of (A) a signal based on an indication of the initial region and (B) a signal based on an indication of the terminal region.

6. The method according to claim 1, wherein at least one of the first and second burst indication signals indicates a level of a detected burst on a logarithmic scale.

7. The method according to claim 1, wherein said generating an attenuation control signal includes generating the attenuation control signal according to a difference between the first burst indication signal and the second burst indication signal.

8. The method according to claim 1, wherein said generating an attenuation control signal includes generating the attenuation control signal according to a degree to which a level of the second burst indication signal exceeds a level of the first burst indication signal.

9. The method according to claim 1, wherein said applying the attenuation control signal to the high-frequency portion of the speech signal comprises at least one among (A) multiplying the high-frequency portion by the attenuation control signal and (B) amplifying the high-frequency portion according to the attenuation control signal.

10. The method according to claim 1, said method comprising processing the speech signal to obtain the low-frequency portion and the high-frequency portion.

11. The method according to claim 1, said method comprising encoding a signal based on the processed high-frequency signal portion into at least a plurality of linear prediction filter coefficients.

12. The method according to claim 11, said method comprising encoding the low-frequency portion into at least a second plurality of linear prediction filter coefficients and an encoded excitation signal, wherein said encoding a signal based on the processed high-frequency signal portion includes encoding, according to a signal based on the encoded excitation signal, a gain envelope of a signal that is based on the processed high-frequency signal portion.

13. The method according to claim 11, said method comprising:

encoding the low-frequency portion into at least a second plurality of linear prediction filter coefficients and an encoded excitation signal; and generating a highband excitation signal based on the encoded excitation signal, wherein said encoding a signal based on the processed high-frequency signal portion includes encoding, according to a signal based on the highband excitation signal, a gain envelope of a signal that is based on the processed high-frequency signal portion.

14. A non-transitory data storage medium having machine-executable instructions that when executed by a processor cause the processor to perform the method of signal processing according to claim 1.

15. An apparatus comprising a highband burst suppressor, said highband burst suppressor comprising:

a first burst detector configured to output a first burst indication signal indicating whether a burst is detected in a low-frequency portion of a speech signal;

a second burst detector configured to output a second burst indication signal indicating whether a burst is detected in a high-frequency portion of the speech signal;

an attenuation control signal generator configured to generate an attenuation control signal according to a relation between the first and second burst indication signals; and a gain control element configured to apply the attenuation control signal to the high-frequency portion of the speech signal, wherein at least one of said first and second burst detectors comprises:

a forward smoother configured to produce a forward smoothed envelope of the corresponding portion of the speech signal, the forward smoothed envelope being smoothed in a positive time direction;

a first region indicator configured to indicate an initial region of a burst in the forward smoothed envelope;

a backward smoother configured to produce a backward smoothed envelope of the corresponding portion of the speech signal, the backward smoothed envelope being smoothed in a negative time direction; and a second region indicator configured to indicate a terminal region of a burst in the backward smoothed envelope.

16. The apparatus according to claim 15, wherein the speech signal is an audio-frequency speech signal.

17. The apparatus according to claim 15, the at least one burst detector comprising a coincidence detector configured to detect a coincidence in time of the initial and terminal regions.

18. The apparatus according to claim 15, the at least one burst detector comprising a coincidence detector configured to indicate a burst according to an overlap in time of the initial and terminal regions.

19. The apparatus according to claim 15, the at least one burst detector comprising a coincidence detector configured to output the corresponding burst indication signal according to a mean of (A) a signal based on an indication of the initial region and (B) a signal based on an indication of the terminal region.

20. The apparatus according to claim 15, wherein at least one of the first and second burst indication signals indicates a level of a detected burst on a logarithmic scale.

21. The apparatus according to claim 15, wherein the attenuation control signal generator is configured to generate the attenuation control signal according to a difference between the first burst indication signal and the second burst indication signal.

22. The apparatus according to claim 15, wherein the attenuation control signal generator is configured to generate the attenuation control signal according to a degree to which a level of the second burst indication signal exceeds a level of the first burst indication signal.

23. The apparatus according to claim 15, wherein the gain control element comprises at least one among a multiplier and an amplifier.

24. The apparatus according to claim 15, said apparatus comprising a filter bank configured to process the speech signal to obtain the low-frequency portion and the high-frequency portion.

25. The apparatus according to claim 15, said apparatus comprising a highband speech encoder configured to encode a signal based on an output of said gain control element into at least a plurality of linear prediction filter coefficients.

26. The apparatus according to claim 25, said apparatus comprising a lowband speech encoder configured to encode the low-frequency portion into at least a second plurality of linear prediction filter coefficients and an encoded excitation signal, wherein said highband speech encoder is configured to encode, according to a signal based on the encoded excitation signal, a gain envelope of a signal that is based on an output of said gain control element.

27. The apparatus according to claim 26, wherein said highband encoder is configured to generate a highband excitation signal based on the encoded excitation signal, and wherein said highband speech encoder is configured to encode, according to a signal based on the highband excitation signal, a gain envelope of a signal that is based on an output of said gain control element.

28. The apparatus according to claim 15, said apparatus comprising a cellular telephone.

29. An apparatus comprising:

means for calculating a first burst indication signal that indicates whether a burst is detected in a low-frequency portion of a speech signal;

means for calculating a second burst indication signal that indicates whether a burst is detected in a high-frequency portion of the speech signal;

means for generating an attenuation control signal according to a relation between the first and second burst indication signals; and means for applying the attenuation control signal to the high-frequency portion of the speech signal wherein at least one of said means for calculating a first burst indication signal and said means for calculating a second burst indication signal comprises:

means for producing a forward smoothed envelope of the corresponding portion of the speech signal, the forward smoothed envelope being smoothed in a positive time direction;

means for indicating an initial region of a burst in the forward smoothed envelope;

means for producing a backward smoothed envelope of the corresponding portion of the speech signal, the backward smoothed envelope being smoothed in a negative time direction; and means for indicating a terminal region of a burst in the backward smoothed envelope.

30. The apparatus according to claim 29, wherein the speech signal is an audio-frequency speech signal.

* * * * *